US011167182B2

(12) United States Patent
Norimura

(10) Patent No.: US 11,167,182 B2
(45) Date of Patent: Nov. 9, 2021

(54) GOLF CLUB HEAD

(71) Applicant: SUMITOMO RUBBER INDUSTRIES, LTD., Hyogo (JP)

(72) Inventor: Takahiro Norimura, Kobe (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 304 days.

(21) Appl. No.: 16/163,901

(22) Filed: Oct. 18, 2018

(65) Prior Publication Data

US 2019/0126107 A1 May 2, 2019

(30) Foreign Application Priority Data

Oct. 31, 2017 (JP) ..... JP2017-211148

(51) Int. Cl.
*A63B 53/04* (2015.01)
*A63B 1/00* (2006.01)
*A63B 102/32* (2015.01)

(52) U.S. Cl.
CPC ..... *A63B 53/04* (2013.01); *A63B 1/00* (2013.01); *A63B 53/047* (2013.01); *A63B 53/0445* (2020.08); *A63B 53/0466* (2013.01); *A63B 2102/32* (2015.10)

(58) Field of Classification Search
CPC ..... A63B 2053/0445; A63B 53/0475
See application file for complete search history.

(56) References Cited

U.S. PATENT DOCUMENTS 4,535,990 A * 8/1985 Yamada ..... A63B 53/04 473/346
5,090,702 A * 2/1992 Viste ..... A63B 53/04 473/331
5,282,624 A * 2/1994 Viste ..... A63B 53/04 473/342
5,306,450 A * 4/1994 Okumoto ..... A63B 53/04 264/45.1
5,676,605 A * 10/1997 Kobayashi ..... A63B 53/04 473/331
5,711,722 A * 1/1998 Miyajima ..... A63B 53/04 473/346
6,203,449 B1 * 3/2001 Kenmi ..... A63B 53/0466 473/346

(Continued)

FOREIGN PATENT DOCUMENTS

JP H04-212387 A 8/1992
JP 2002-253709 A 9/2002

(Continued)

*Primary Examiner* — William M Pierce
(74) *Attorney, Agent, or Firm* — Studebaker & Brackett PC

(57) ABSTRACT

A head includes a face part, a sole part, and a hosel part. The face part includes a hitting surface and a face back surface. A plurality of score lines are formed on the hitting surface. One or two or more back grooves are formed on the face back surface. With reference to a face center, the face part is divided into four regions: a toe upper region; a toe lower region; a heel upper region; and a heel lower region, and back-groove projected areas of at least two regions out of the four regions are different from each other. Back-groove occupation ratios of at least two regions out of the four regions may be different from each other.

14 Claims, 18 Drawing Sheets

(56) References Cited

U.S. PATENT DOCUMENTS

| | | | | |
|---|---|---|---|---|
| 6,322,459 | B1 * | 11/2001 | Nishimura | A63B 53/04 473/330 |
| D478,952 | S * | 8/2003 | Greene | D21/759 |
| D481,432 | S * | 10/2003 | Greene | D21/748 |
| D490,129 | S * | 5/2004 | Greene | D21/748 |
| 7,029,403 | B2 * | 4/2006 | Rice | A63B 53/0466 473/329 |
| 7,066,833 | B2 * | 6/2006 | Yamamoto | A63B 53/04 473/330 |
| 7,549,934 | B2 * | 6/2009 | Rice | A63B 60/00 473/329 |
| 7,704,162 | B2 * | 4/2010 | Rice | A63B 60/00 473/329 |
| 7,794,335 | B2 * | 9/2010 | Cole | A63B 53/04 473/342 |
| 7,935,001 | B2 * | 5/2011 | Meyer | A63B 53/0466 473/314 |
| 8,449,406 | B1 * | 5/2013 | Frame | A63B 53/04 473/329 |
| 2009/0023513 | A1 | 1/2009 | Shibata et al. | |

FOREIGN PATENT DOCUMENTS

| | | | |
|---|---|---|---|
| JP | 2002-315856 | A | 10/2002 |
| JP | 2008-279249 | A | 11/2008 |
| JP | 2014-113267 | A | 6/2014 |

* cited by examiner

GOLF CLUB HEAD

The present application claims priority on Patent Application No. 2017-211148 filed in JAPAN on Oct. 31, 2017. The entire contents of this Japanese Patent Application are hereby incorporated by reference.

BACKGROUND OF THE INVENTION

Field of the Invention

The present disclosure relates to a golf club head.

Description of the Related Art

A head including a hitting surface and a face back surface that is a surface opposite to the hitting surface has been known. For example, heads such as an iron type head and a hollow head include the hitting surface and the face back surface. JP2002-315856A discloses a golf club head having a face back surface on which a honeycomb structure is formed.

SUMMARY OF THE INVENTION

The inventor of the present application has found that a new structure of a face back surface can enhance a degree of freedom in design of a head. The present disclosure provides a golf club head in which the degree of freedom in design is enhanced.

In one aspect, a golf club head includes a face part, a sole part and a hosel part. The face part includes a hitting surface and a face back surface. A plurality of score lines are formed on the hitting surface. One or two or more back grooves are formed on the face back surface. When the face part is divided into four regions: a toe upper region; a toe lower region; a heel upper region; and a heel lower region, by using a face center as a reference, back-groove projected areas in at least two of the four regions are different from each other.

DESCRIPTION OF THE PREFERRED EMBODIMENTS

Hereinafter, preferred embodiments will be described in detail with appropriate references to the accompanying drawings.

In the present disclosure, the following terms are defined.

[Base State]

The base state is a state where a head is placed at a specified lie angle and real loft angle on a horizontal plane HP. In the base state, a center axis line Z (shaft axis line Z) of a hosel hole of the head is disposed in a perpendicular plane VP (see FIG. 18). The perpendicular plane VP is a plane perpendicular to the horizontal plane HP. In the base state, a face surface (hitting surface) is inclined at a real loft angle with respect to the perpendicular plane VP. The specified lie angle and real loft angle are described in, for example, a product catalog. In the head of the base state, score lines may be parallel to the horizontal plane HP.

[Toe-Heel Direction]

Figure 18:
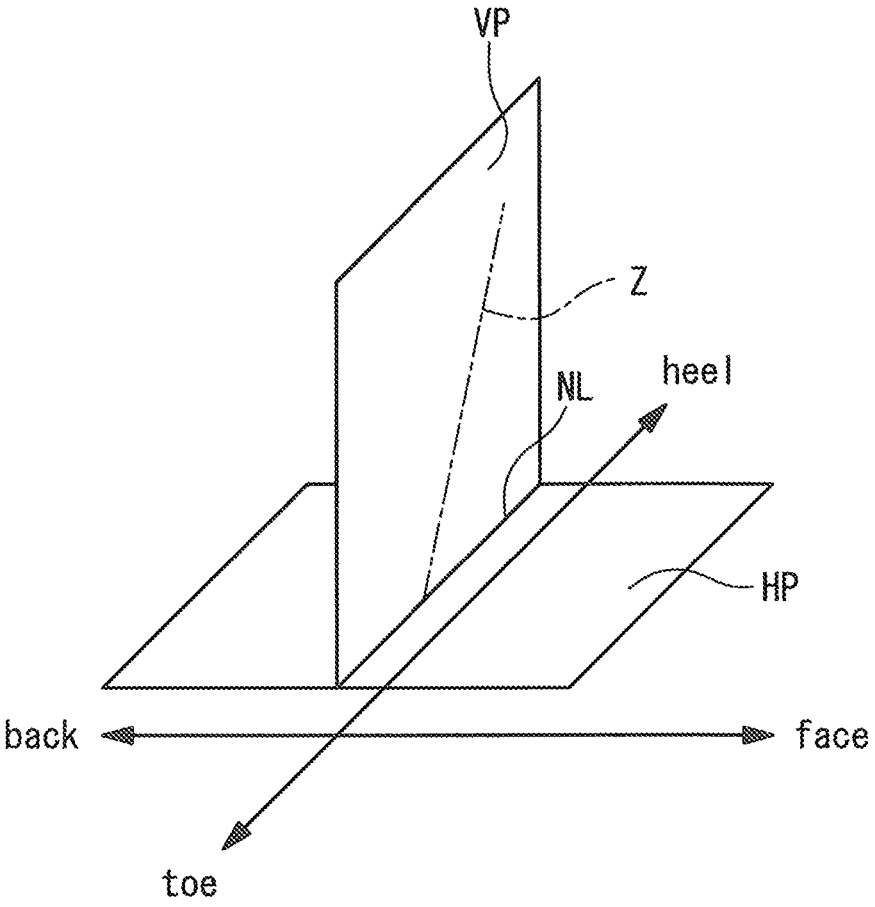
FIG. 18 is a view for illustrating a base state.

In the head of the base state, a direction of an intersection line NL between the perpendicular plane VP and the horizontal plane HP is the toe-heel direction (see FIG. 18). A toe side and a heel side used in the present disclosure should be based on the toe-heel direction. Score lines f1 may be parallel to the toe-heel direction.

[Face-Back Direction]

A direction perpendicular to the toe-heel direction and parallel to the horizontal plane HP is the face-back direction (see FIG. 18). A face side and a back side used in the present disclosure should be based on the face-back direction.

[Up-Down Direction]

A direction perpendicular to the toe-heel direction and parallel to the hitting surface is the up-down direction. An upper side and a lower side used in the present disclosure should be based on the up-down direction.

[Face Perpendicular Direction]

A direction perpendicular to the hitting surface (face surface) is defined as the face perpendicular direction. In other words, a direction of a normal line of the hitting surface is defined as the face perpendicular direction.

[Face Center]

Figure 2:
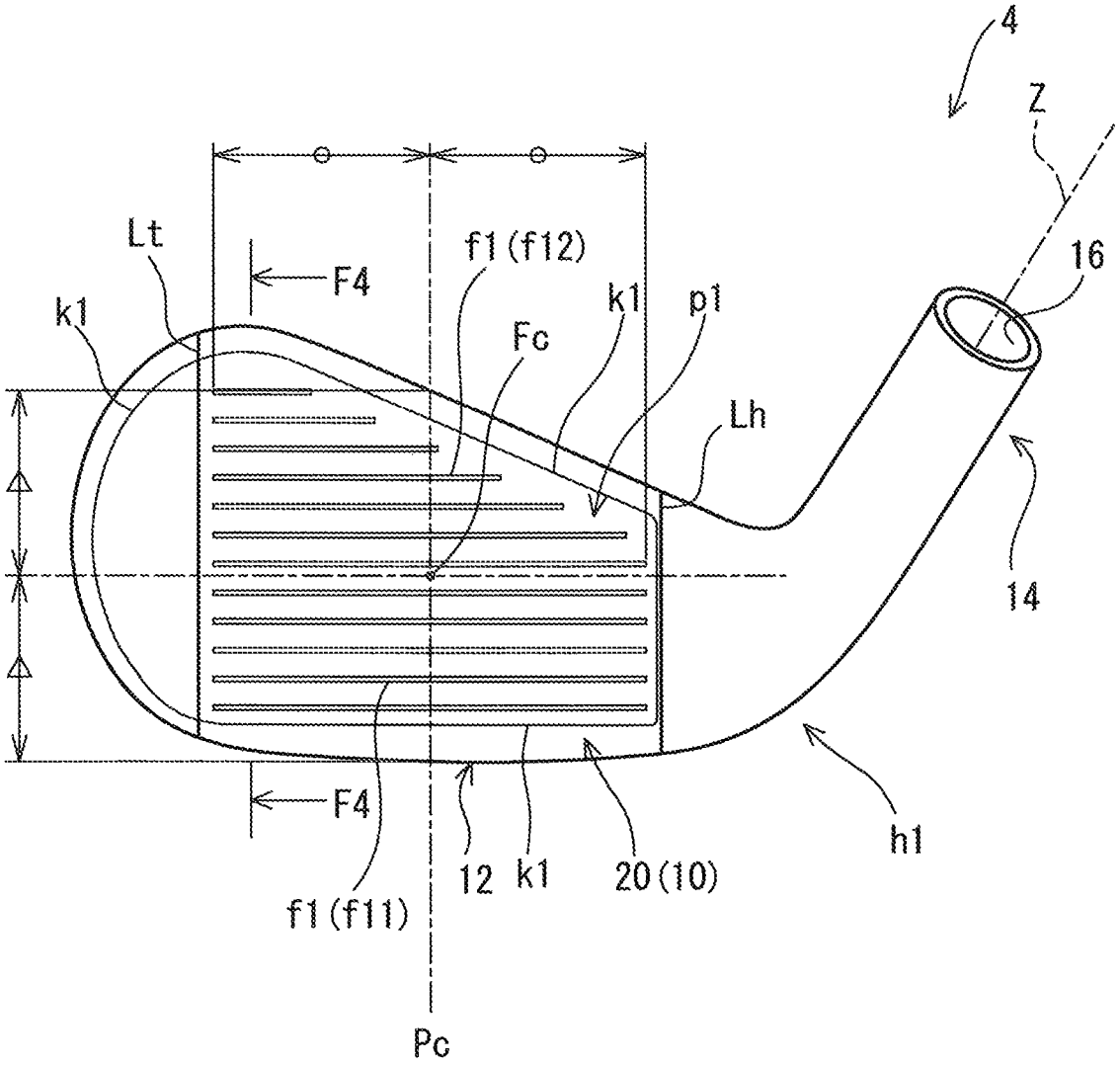
FIG. 2 is a front view of a golf club head according to the first embodiment.

A middle position of a longest score line f11 in the toe-heel direction is a middle position Pc of a score line in the toe-heel direction (see FIG. 2). On the middle position Pc, a center point of the face surface in the up-down direction is determined. The center point in the up-down direction is the face center Fc (see FIG. 2). The middle position Pc in the toe-heel direction can be determined based on the longest score line f11 which is located on the lowest position.

[Projected Area]

An area shown in a projected image generated by projecting an object on a plane parallel to the hitting surface is the projected area. This projected image is a parallel projection image, and the direction of the projection is the face perpendicular direction. Figures, such as FIG. 2 described later, are also the projected images. The projected area of each score line is equal to the area of an opening of the score line. Similarly, the projected area of a back groove is equal to the area of an opening of the back groove. As shown in figures such as FIG. 8 described later, the score lines f1 and the back groove b1 are projected so that both of them can be seen though in the projected image.

[Back-Groove Projected Area]

The back-groove projected area in a region means the sum of the projected areas of all of one or two or more back grooves present in the region.

[Back-Groove Occupation Ratio]

The back-groove occupation ratio in a region means a ratio of the back-groove projected area in the region to the whole area of the region.

Figure 1:
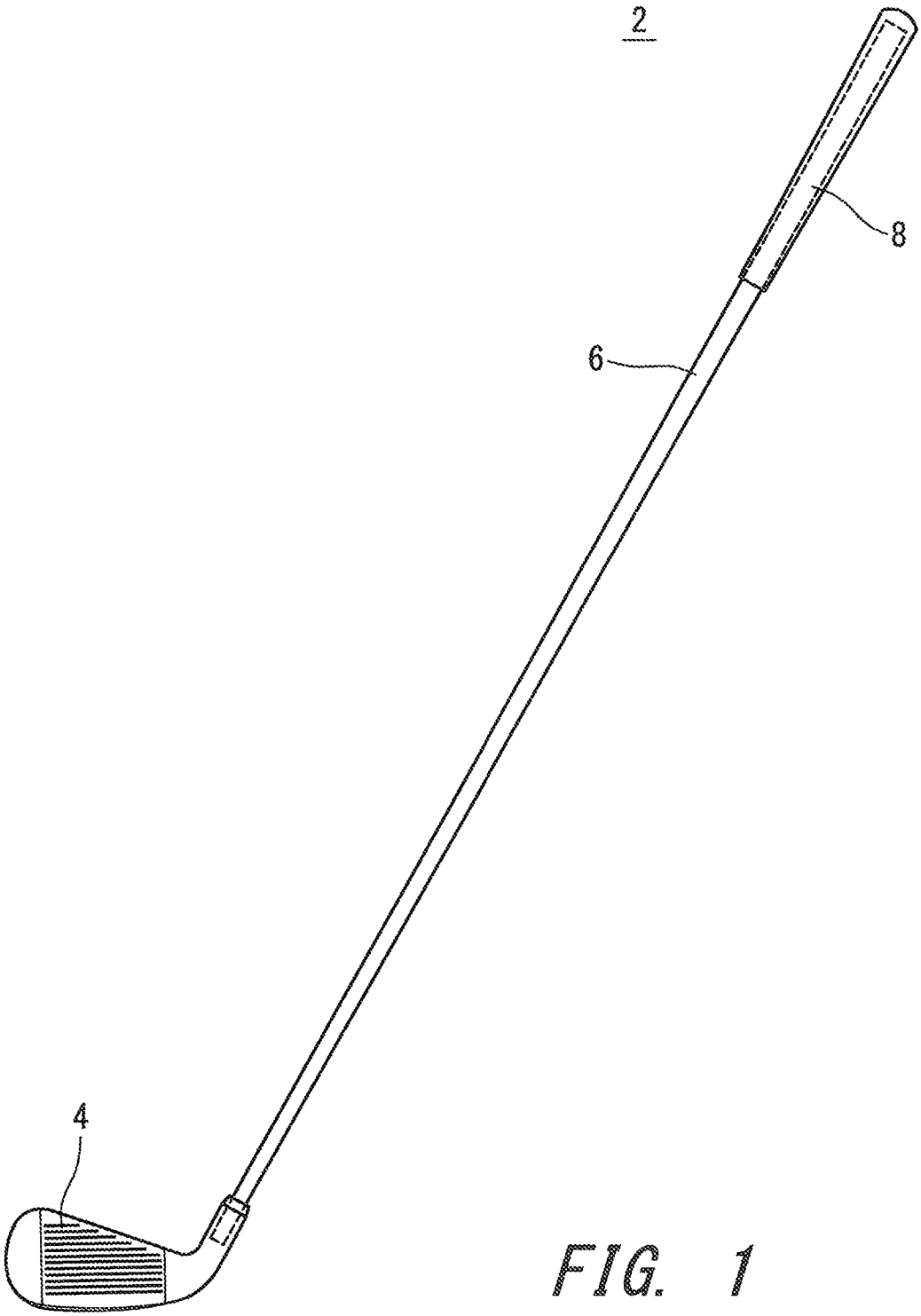
FIG. 1 shows a golf club according to a first embodiment.

FIG. 1 shows a golf club 2 according to a first embodiment. The club 2 includes a head 4, a shaft 6, and a grip 8. The head 4 is attached to a tip portion of the shaft 6. The grip 8 is attached to a butt portion of the shaft 6.

Figure 3:
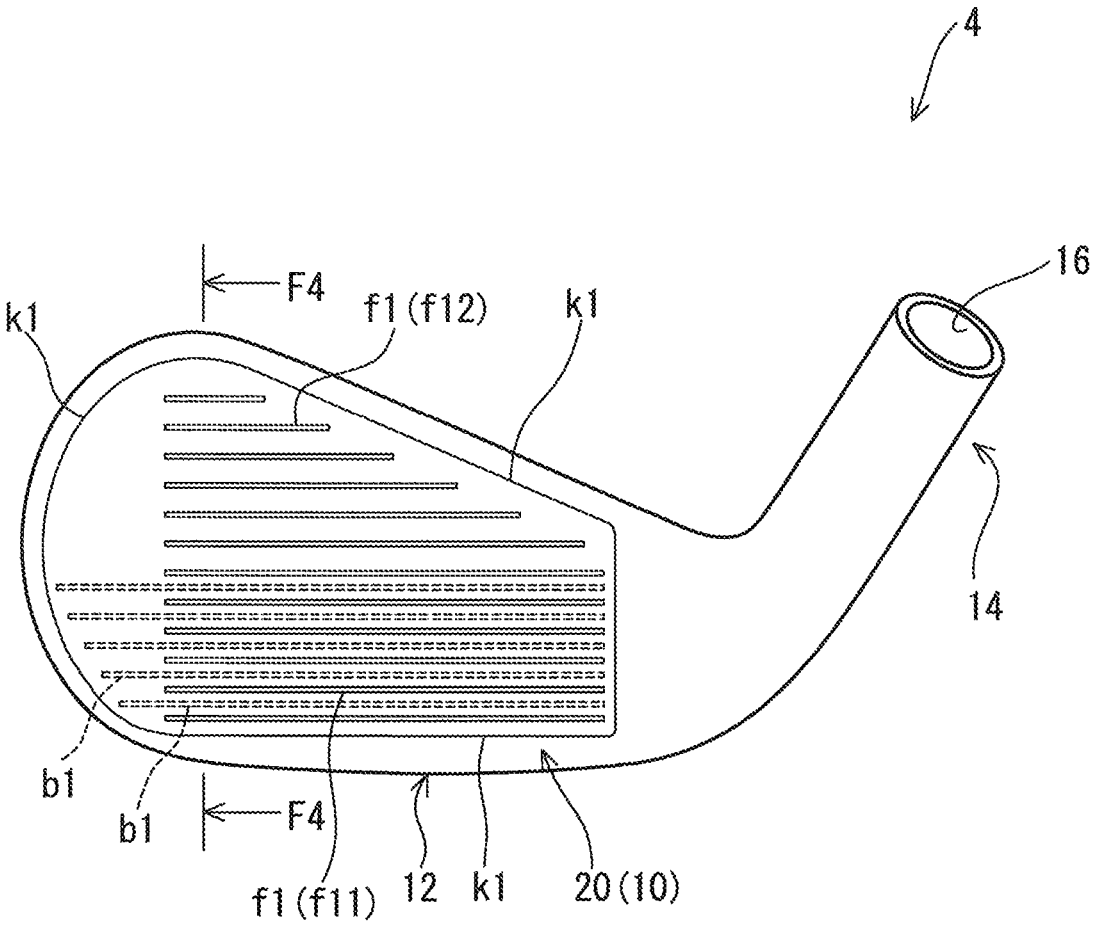
FIG. 3 is the same front view as FIG. 2.
Figure 4:
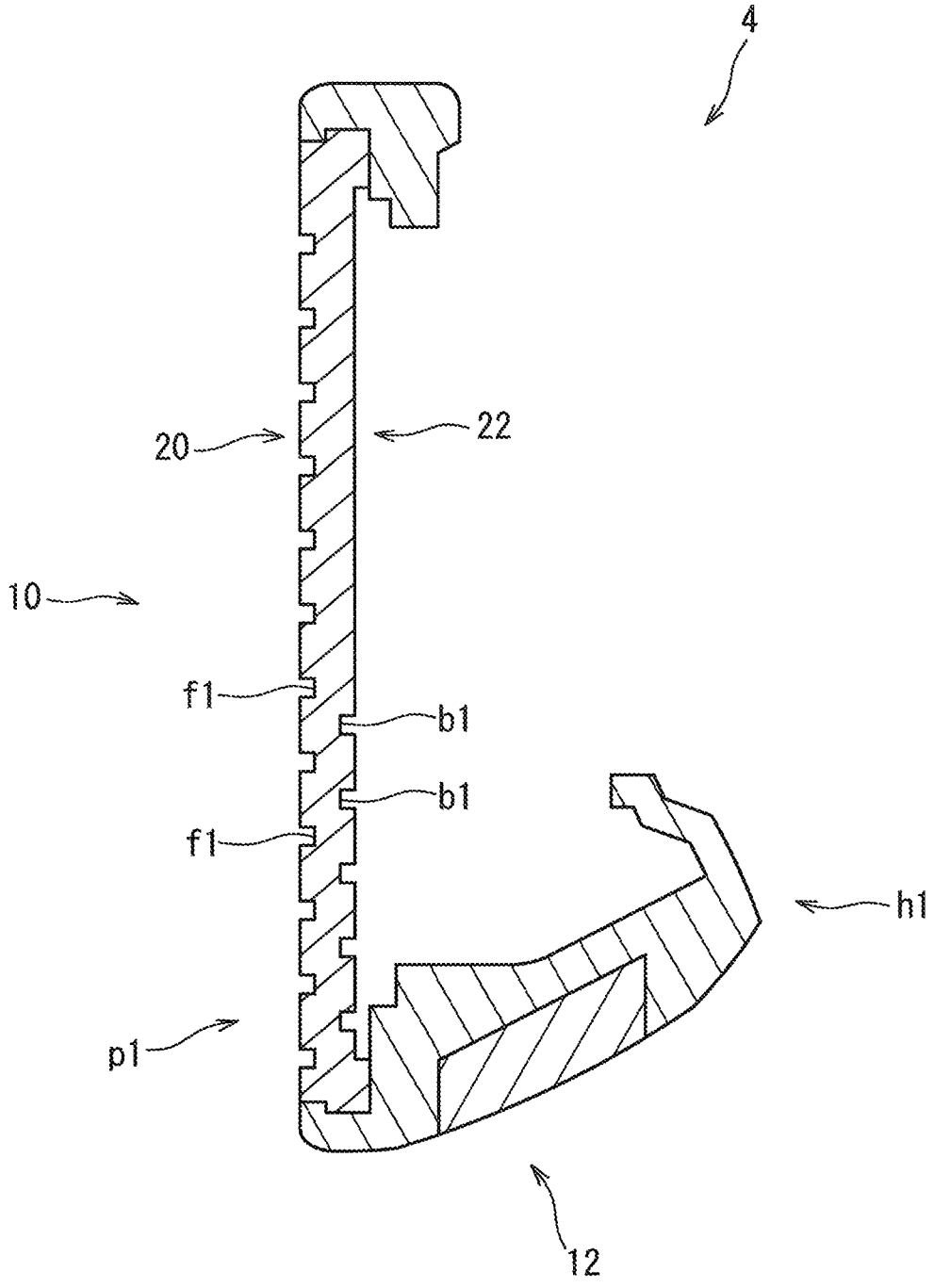
FIG. 4 is a sectional view taken along line F4-F4 in FIG. 3.

FIG. 2 is a front view of the head 4. FIG. 2 is a diagram viewed from the front of a hitting surface. As with FIG. 2, FIG. 3 is a front view of the head 4. In FIG. 3, back grooves described below are shown by dashed lines. FIG. 4 is a sectional view taken along line F4-F4 in FIG. 2 and FIG. 3.

The head 4 is an iron type head. The head 4 includes a face part 10, a sole part 12, and a hosel part 14. The hosel part 14 includes a hosel hole 16. The tip portion of the shaft 6 is inserted and fixed to the hosel hole 16.

As shown in FIG. 4, the face part 10 includes a hitting surface 20 and a face back surface 22. The hitting surface 20 is a front surface of the face part 10. The hitting surface 20 is a surface brought into contact with a ball in a shot. The face back surface 22 is a rear surface of the face part 10. In the face part 10, the face back surface 22 is a surface opposite to the hitting surface 20.

The head 4 is a cavity back iron head. The face back surface 22 constitutes a bottom surface of the cavity of the head 4.

The hitting surface 20 is a plane surface. The hitting surface 20 may be a curved surface. The face back surface 22 is a plane surface. The face back surface 22 is parallel to the hitting surface 20. The face back surface 22 may be a curved surface. The face back surface 22 may not be parallel to the hitting surface 20.

As shown in FIG. 2, a plurality of score lines f1 are provided on the hitting surface 20. The score lines f1 are grooves. The score lines f1 contribute to increase in backspin. As the score lines f1, a plurality of longest score lines f11 and a plurality of non-longest score lines f12 are provided. The non-longest score lines f12 are shorter than the longest score lines f11. All the score lines f1 extend along a straight line. All the score lines f1 are parallel to each other. Toe-heel direction positions of toe-side ends of all the score lines f1 are the same.

The hitting surface 20 is subjected to a treatment for increasing a surface roughness. A typical example of the surface treatment is a blasting treatment. Examples of the blasting treatment include and a sand-blasting treatment and a shot-blasting treatment. FIG. 2 shows a boundary line Lt and a boundary line Lh as boundary lines between a portion that is subjected to the blasting treatment and a portion that is not subjected to the blasting treatment. The boundary line Lt is provided on the toe side relative to the score lines f1. The boundary line Lh is provided on the heel side relative to the score lines f1. A portion between the boundary line Lt and the boundary line Lh is subjected to the blasting treatment. A portion located on the toe side relative to the boundary line Lt is not subjected to the blasting treatment. A portion located on the heel side relative to the boundary line Lh is not subjected to the blasting treatment. The boundary line Lt and the boundary line Lh can be visually recognized.

As shown in FIG. 3 and FIG. 4, a groove b1 is provided on the face back surface 22. In the present disclosure, the groove b1 is also referred to as a back groove.

A plurality of back grooves b1 are provided on the face back surface 22. As shown in FIG. 3, the back grooves b1 extend along a straight line. As shown in other embodiments described later, the back groove b1 may be curved.

As shown in FIG. 3, all the back grooves b1 are parallel to each other. The back grooves b1 may not be parallel to each other. The back grooves b1 may intersect each other.

The back grooves b1 are parallel to the score lines f1. All the back grooves b1 are parallel to the score lines f1. The back grooves b1 may not be parallel to the score lines f1.

The head 4 is formed by joining a face member p1 to a head body h1. As shown in FIG. 4, the face member p1 has a plate shape as a whole. The head body h1 includes an opening, and the face member p1 is fitted to the opening. FIG. 2 and FIG. 3 show a boundary k1 between the head body h1 and the face member p1. Usually, the boundary k1 is not conspicuous. The boundary k1 might be hardly visually recognized.

The material of the head body h1 is different from the material of the face member p1. Respective materials can be optimally selected for the head body h1 and the face member p1. For example, the head body h1 may have a specific gravity greater than that of the face member p1.

The hitting surface 20 is constituted by a front surface of the face member p1 and a front surface of the head body h1 located on the circumference of the face member p1. The face back surface 22 is constituted by a rear surface of the face member p1.

The head 4 is not limited to a head made by joining the face member p1 to the head body h1. The face member p1 may not be used. The face part 10 may be integrally formed together with another portion of the head 4. The whole head 4 may be integrally formed.

The use of the face member p1 can facilitate forming of the score lines f1 and the back grooves b1. For example, the score lines f1 and the back grooves b1 can be formed on the face member p1 in a solitary state before the face member p1 is attached to the head body h1.

In the present disclosure, regions made by dividing the face part 10 are defined.

Figure 5:
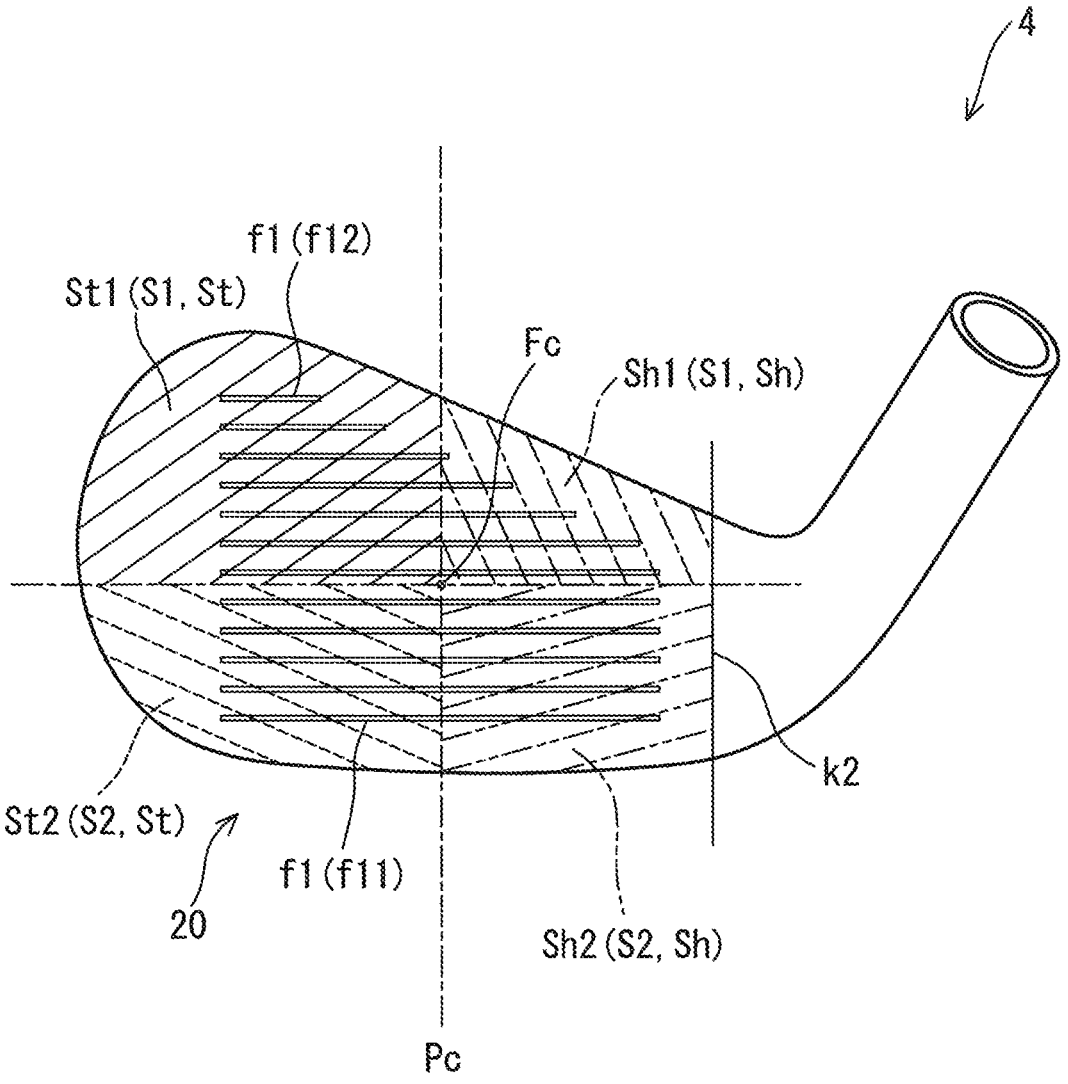
FIG. 5 is the same front view as FIG. 2, and shows four regions (a toe upper region, a toe lower region, a heel upper region, and a heel lower region) by using hatchings different from each other.

FIG. 5 shows four regions St1, St2, Sh1, and Sh2 made by dividing the face part 10. The regions are shown by respective hatchings different from each other.

[Toe Upper Region St1]

The region St1 is a region located on the upper side relative to the face center Fc, and on the toe side relative to the face center Fc. The region St1 is also referred to as a toe upper region. In FIG. 5, the toe upper region St1 is shown by a hatching with solid lines.

[Toe Lower Region St2]

The region St2 is a region located on the lower side relative to the face center Fc, and on the toe side relative to the face center Fc. The region St2 is also referred to as a toe lower region. In FIG. 5, the toe lower region St2 is shown by a hatching with dashed lines.

[Heel Upper Region Sh1]

The region Sh1 is a region located on the upper side relative to the face center Fc, and on the heel side relative to the face center Fc. The region Sh1 is also referred to as a heel upper region. In FIG. 5, the heel upper region Sh1 is shown by a hatching with one-dot chain lines.

[Heel Lower Region Sh2]

The region Sh2 is a region located on the lower side relative to the face center Fc, and on the heel side relative to the face center Fc. The region Sh2 is also referred to as a heel lower region. In FIG. 5, the heel lower region Sh2 is shown by a hatching with two-dot chain lines.

The plurality of (five) score lines f1 which are located on the lower side relative to the face center Fc extend from the heel lower region Sh2, through the middle position Pc of the score line, to the toe lower region St2. The plurality of (five) score lines f1 which are located on the upper side relative to the face center Fc extend from the heel upper region Sh1, through the middle position Pc of the score line, to the toe upper region St1. At least one score line f1 is located only in the toe upper region St1. The score line f1 (non-longest score line f12) located on the uppermost side is located in the toe upper region St1 only.

[Face Upper Region S1]

A region located on the upper side relative to the face center Fc is also referred to as a face upper region S1. The face upper region S1 is a region made by uniting the toe upper region St1 and the heel upper region Sh1.

[Face Lower Region S2]

A region located on the lower side relative to the face center Fc is also referred to as a face lower region S2. The face lower region S2 is a region made by uniting the toe lower region St2 and the heel lower region Sh2.

[Face Toe Region St]

A region located on the toe side relative to the face center Fc is also referred to as a face toe region St. The face toe region St is a region made by uniting the toe upper region St1 and the toe lower region St2.

[Face Heel Region Sh]

A region located on the heel side relative to the face center Fc is also referred to as a face heel region Sh. The face heel region Sh is a region made by uniting the heel upper region Sh1 and the heel lower region Sh2.

FIG. 5 shows a boundary line k2. The boundary line k2 is a heel-side edge of the hitting surface 20. A portion located on the heel side relative to the boundary line k2 is not a plane surface but a curved surface that is smoothly continuous from the hitting surface 20 (plane part). The boundary line k2 itself is not visually recognized. The boundary line k2 is located on the heel side relative to the above-mentioned boundary line Lh (see FIG. 2).

Figure 6:
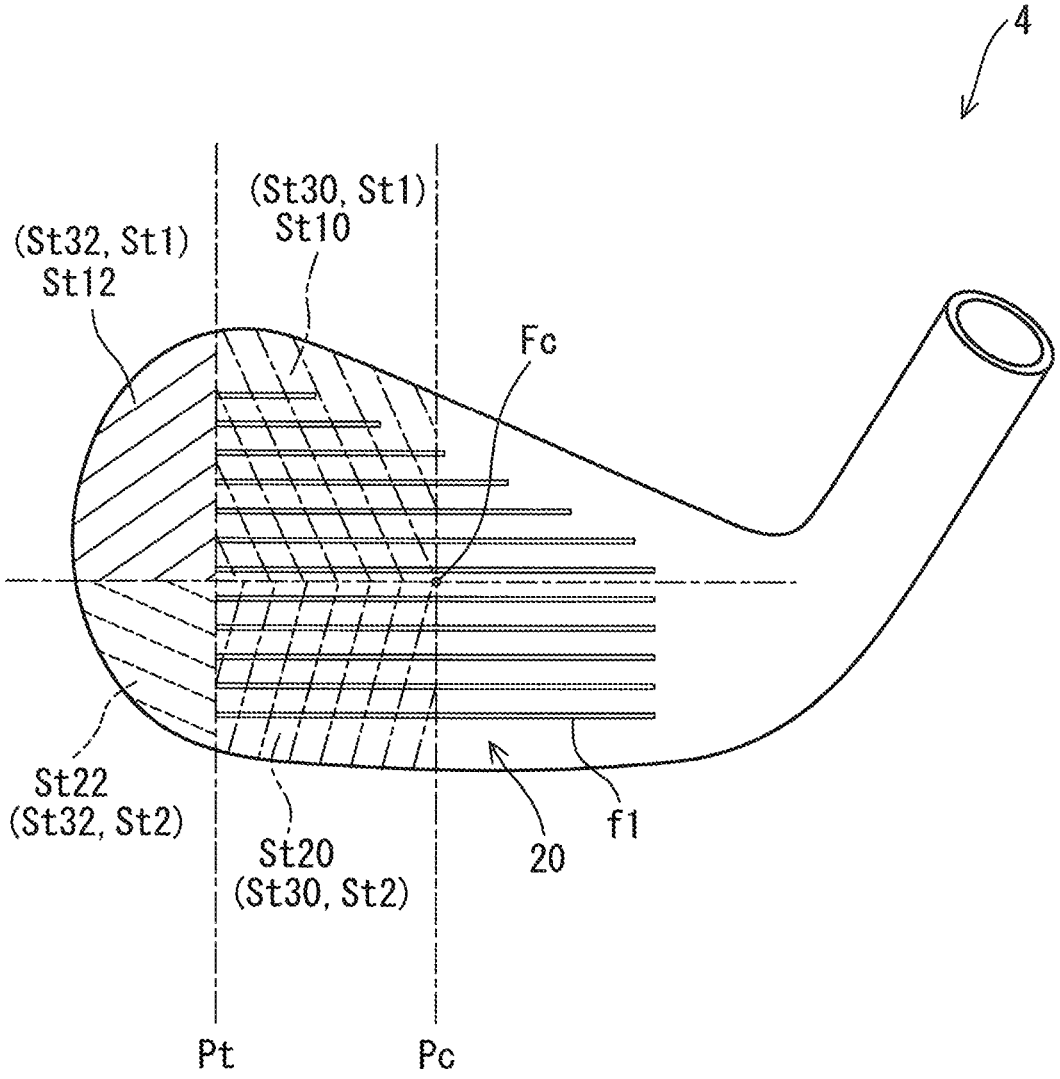
FIG. 6 is the same front view as FIG. 2, and shows two regions obtained by further dividing the toe upper region, and two regions obtained by further dividing the toe lower region.

The toe-heel direction position of the toe-side ends of the score lines f1 is defined as a toe-end position Pt (see FIG. 6). The toe upper region St1 can be further divided into two regions with reference to the toe-end position Pt.

[Toe Upper Line Region St10]

Of the toe upper region St1, a region located on the heel side relative to the toe-end position Pt is also referred to as a toe upper line region St10. In FIG. 6, the toe upper line region St10 is shown by a hatching with one-dot chain lines.

[Toe Upper Out-of-Line Region St12]

Of the toe upper region St1, a region located on the toe side relative to the toe-end position Pt is also referred to as a toe upper out-of-line region St12. In FIG. 6, the toe upper out-of-line region St12 is shown by a hatching with solid lines.

Similarly, the toe lower region St2 can be divided into two regions.

[Toe Lower Line Region St20]

Of the toe lower region St2, a region located on the heel side relative to the toe-end position Pt is also referred to as a toe lower line region St20. In FIG. 6, the toe lower line region St20 is shown by a hatching with two-dot chain lines.

[Toe Lower Out-of-Line Region St22]

Of the toe lower region St2, a region located on the toe side relative to the toe-end position Pt is also referred to as a toe lower out-of-line region St22. In FIG. 6, the toe lower out-of-line region St22 is shown by a hatching with dashed lines.

[Toe Line Region St30]

A region made by uniting the toe upper line region St10 and the toe lower line region St20 is defined as a toe line region St30.

[Toe Out-of-Line Region St32]

A region made by uniting the toe upper out-of-line region St12 and the toe lower out-of-line region St22 is defined as a toe out-of-line region St32.

[Quadrangular Region R]

Figure 7:
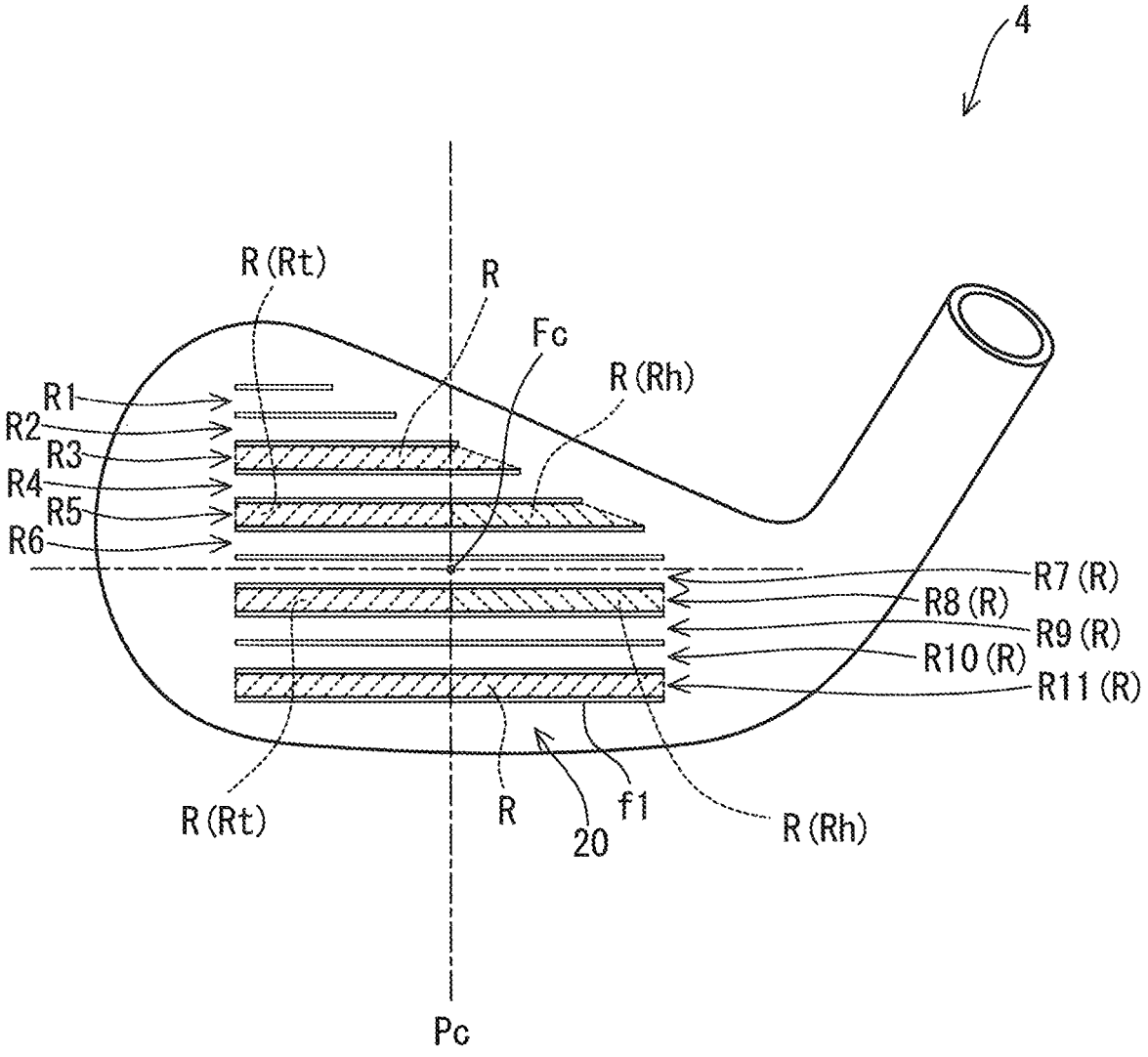
FIG. 7 is the same front view as FIG. 2, and shows quadrangular regions.

In the present disclosure, a quadrangular region R is defined. As shown in FIG. 7, the quadrangular region R is a region having two adjacent score lines f1 as a top side and a bottom side thereof. The quadrangular region R is present each between two score lines f1 adjacent to each other. In the embodiment of FIG. 7, since the number of the score lines f1 is 12, eleven quadrangular regions R are present.

[Toe Partial Region Rt]

Of each quadrangular region R, a region located on the toe side relative to the face center Fc is the toe partial region Rt (see FIG. 7). In the embodiment of FIG. 7, since the eleven quadrangular regions Rare present, eleven toe partial regions Rt are present.

[Heel Partial Region Rh]

Of each quadrangular region R, a region located on the heel side relative to the face center Fc is the heel partial region Rh (see FIG. 7). In the embodiment of FIG. 7, one of the eleven quadrangular regions R does not have the heel partial region Rh. That is, the quadrangular region R located between the uppermost score line f1 and the second uppermost score line f1 does not include the heel partial region Rh. The other ten quadrangular regions R include respective heel partial regions Rh. Normally, at least one of the quadrangular regions R does not include the heel partial region Rh.

Figure 8:
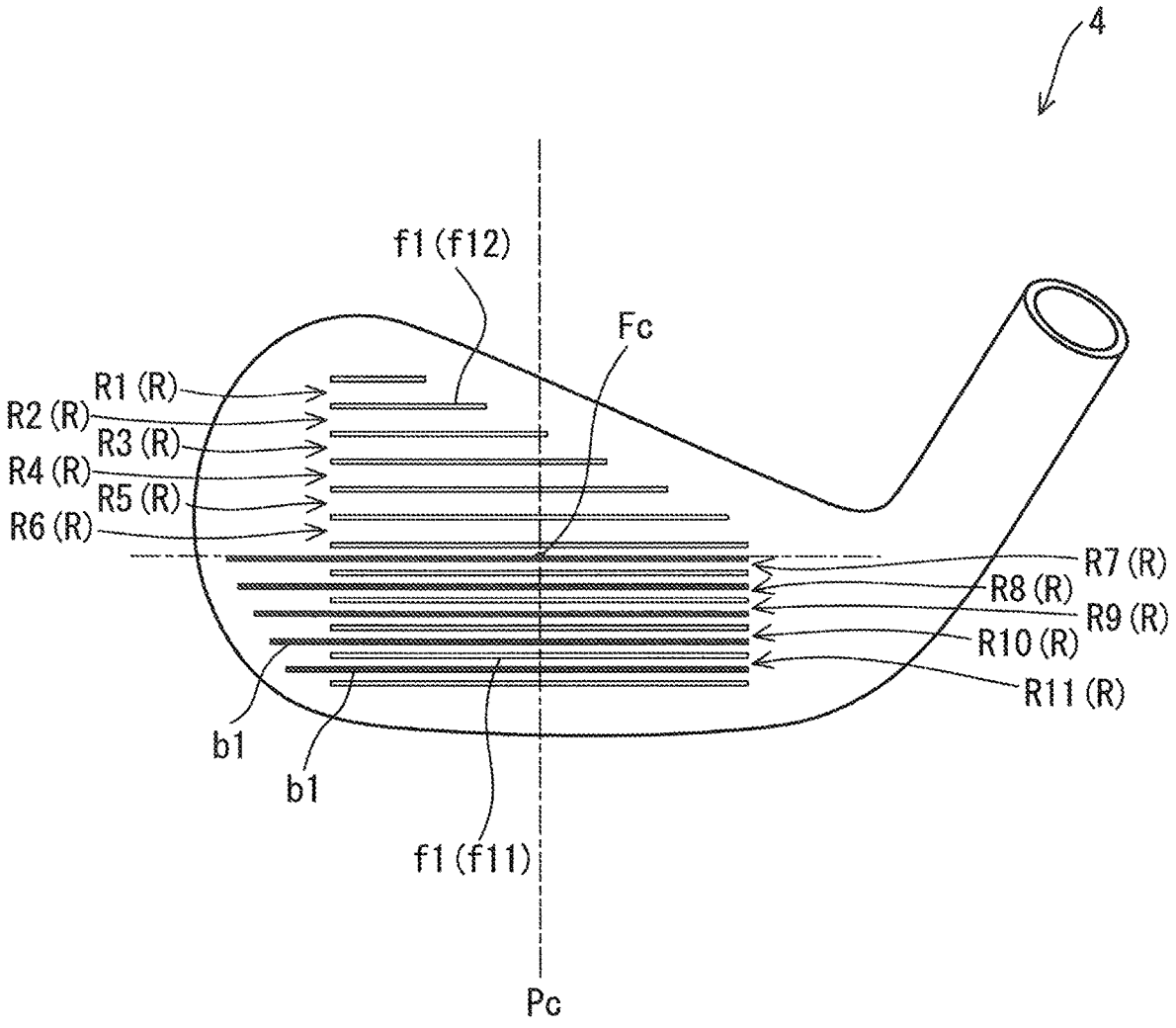
FIG. 8 is the same front view as FIG. 2, and shows back grooves with solid filled lines.

Similar to FIG. 2 for example, FIG. 8 is a front view (projected image) of the head 4 of the first embodiment. Unlike FIG. 2, the back grooves b1 are solid filled in FIG. 8. The projected area of each back groove b1 is the projected area (opening area) of the opening of the back groove b1. The areas of the portions which are solid filled in black in FIG. 8 are the projected areas of the back grooves b1.

In the head 4, the plurality of (five) back grooves b1 are provided. All the back grooves b1 are provided in the face lower region S2. The back groove b1 is not provided in the face upper region S1.

All the back grooves b1 extend along a straight line. All the back grooves b1 are parallel to the score lines f1. Each of the back grooves b1 is disposed on each quadrangular region R. Each back groove b1 is located at the center of the up-down direction width of the corresponding quadrangular region R.

The back grooves b1 extend from the heel lower region Sh2, through the toe lower line region St20, to the toe lower out-of-line region St22. Each back groove b1 includes a portion located in the toe lower out-of-line region St22. The upper the location of the back groove b1 is, the longer the portion located in the toe lower out-of-line region St22 is.

Figure 9:
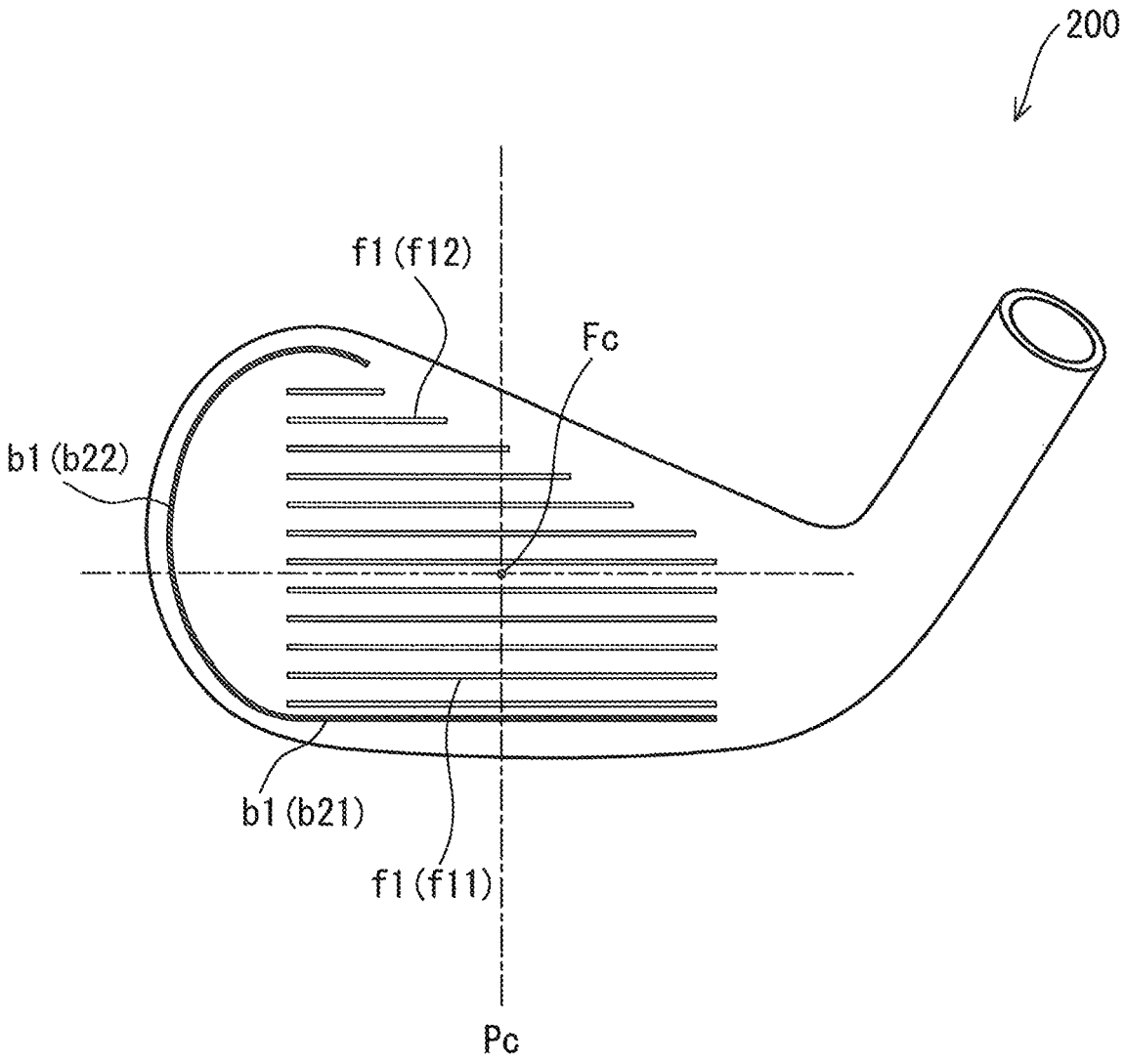
FIG. 9 is a front view of a head according to a second embodiment, and also shows a back groove with a solid filled line.

FIG. 9 is a front view (projected image) of a head 200 according to a second embodiment.

The head 200 includes a back groove b1. The back groove b1 includes a straight portion b21 and a curved portion b22 extending from a toe-side end of the straight portion b21.

The straight portion b21 is parallel to the score lines f1. The straight portion b21 is located on the lower side relative to the lowermost score line f1. The straight portion b21 extends from the heel lower region Sh2 to the toe lower region St2.

The curved portion b22 is located in the face toe region St. The curved portion b22 extends from the toe lower out-of-line region St22, through the toe upper out-of-line region St12, to the toe upper line region St10. The end of the curved portion b22 is located on the upper side relative to the uppermost score line f1. The curved portion b22 extends along the contour line of the hitting surface 20. The curved portion b22 is curved so as to project toward the outside of the head 200. The curved portion b22 can effectively reduce the rigidity of the toe side of the face part.

Figure 10:
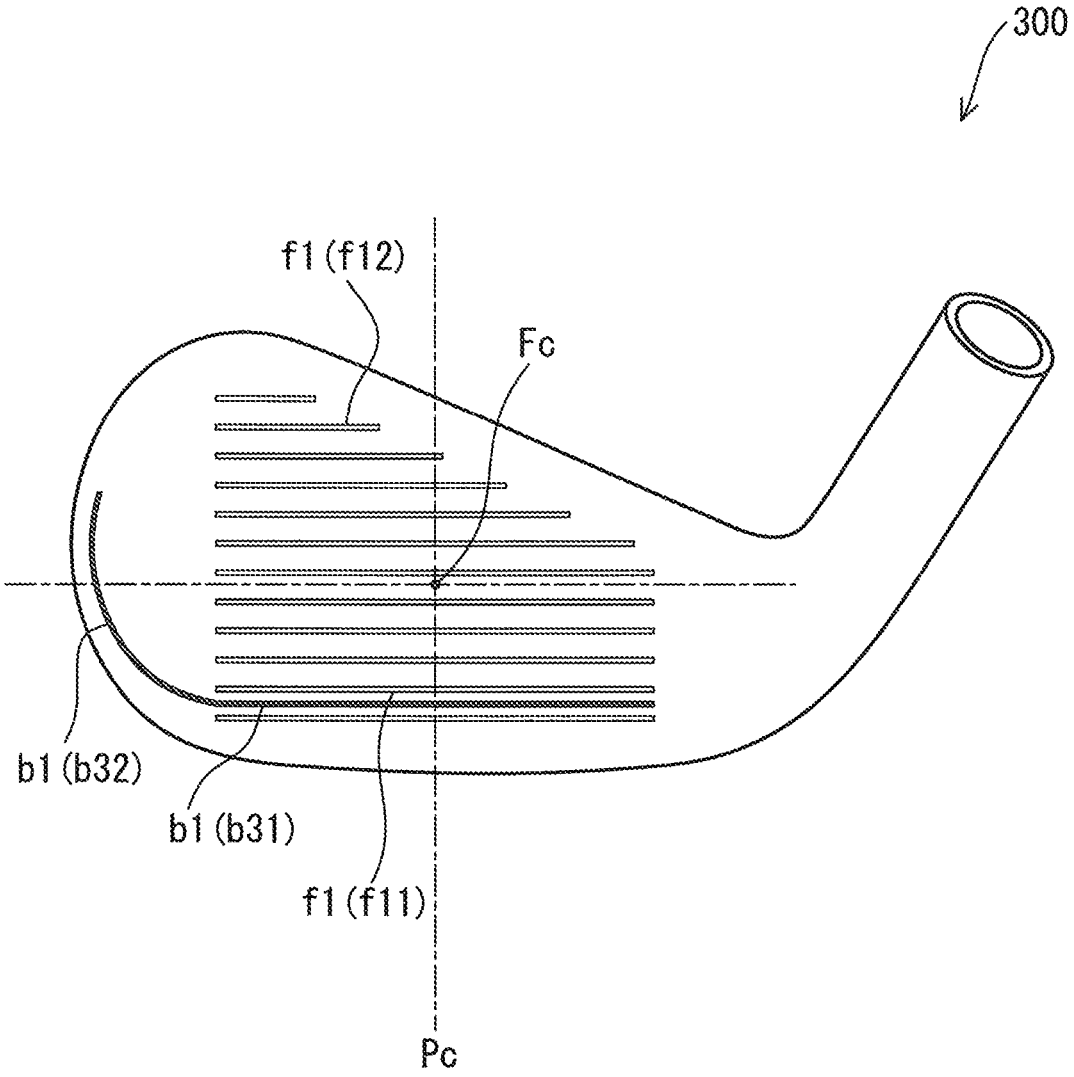
FIG. 10 is a front view of a head according to a third embodiment, and also shows a back groove with a solid filled line.

FIG. 10 is a front view (projected image) of a head 300 according to a third embodiment.

The head 300 includes a back groove b1. The back groove b1 includes a straight portion b31 and a curved portion b32 extending from a toe-side end of the straight portion b31.

The straight portion b31 is parallel to the score lines f1. The straight portion b31 is located on the upper side relative to the lowermost score line f1. The straight portion b31 is located between the lowermost score line f1 and the second lowermost score line f1. The straight portion b31 extends from the heel lower region Sh2 to the toe lower region St2.

The curved portion b32 is located in the face toe region St. The curved portion b32 is located in the toe out-of-line region St32. The curved portion b32 extends from the toe lower out-of-line region St22 to the toe upper out-of-line region St12. The curved portion b32 extends along the contour line of the hitting surface 20. The curved portion b32 is curved so as to project toward the outside of the head 300. The curved portion b32 can effectively reduce the rigidity of the toe lower side of the face part.

Figure 11:
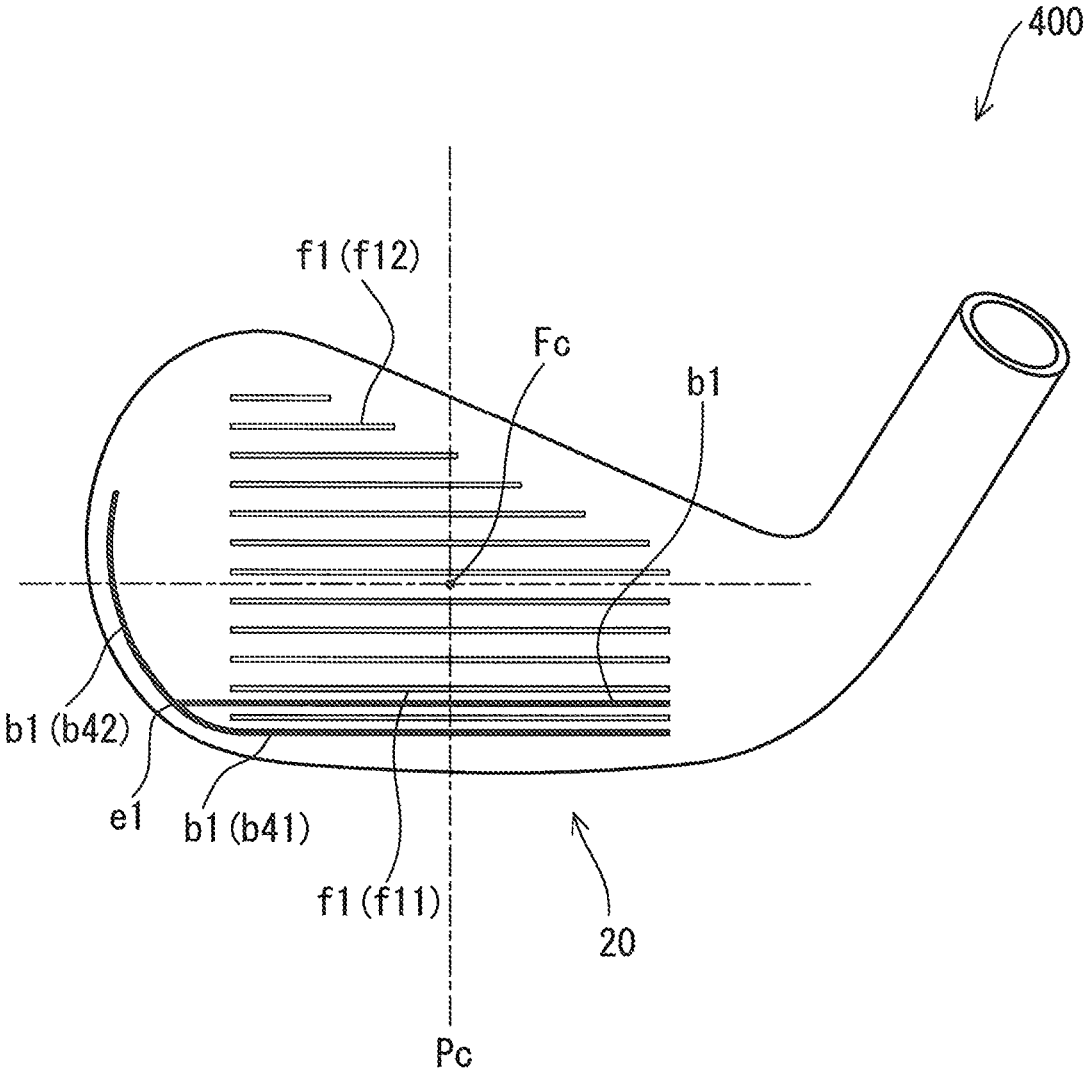
FIG. 11 is a front view of a head according to a fourth embodiment, and also shows back grooves with solid filled lines.

FIG. 11 is a front view (projected image) of a head 400 according to a fourth embodiment.

The head 400 includes a first back groove b1 and a second back groove b1.

The first back groove b1 extends along a straight line. The first back groove b1 is parallel to the score lines f1. The first back groove b1 is located between adjacent score lines f1. The first back groove b1 is located between the lowermost score line f1 and the second lowermost score line f1. The first back groove b1 extends from the heel lower region Sh2 to the toe lower region St2.

The second back groove b1 includes a straight portion b41 and a curved portion b42 extending from a toe-side end of the straight portion b41.

The straight portion b41 is parallel to the score lines f1. The straight portion b41 is located on the lower side relative to the lowermost score line f1. The straight portion b41 extends from the heel lower region Sh2 to the toe lower region St2.

The curved portion b42 is located in the toe out-of-line region St32. The curved portion b42 extends from the toe lower out-of-line region St22 to the toe upper out-of-line region St12. The curved portion b42 extends along the contour line of the hitting surface 20. The curved portion b42 is curved so as to project toward the outside of the head 400.

The first back groove b1 intersects the second back groove b1. The first back groove b1 intersects (the curved portion b42 of) the second back groove b1 at a toe-side end e1 of the first back groove b1. As such, the back grooves b1 may intersect each other.

Figure 12:
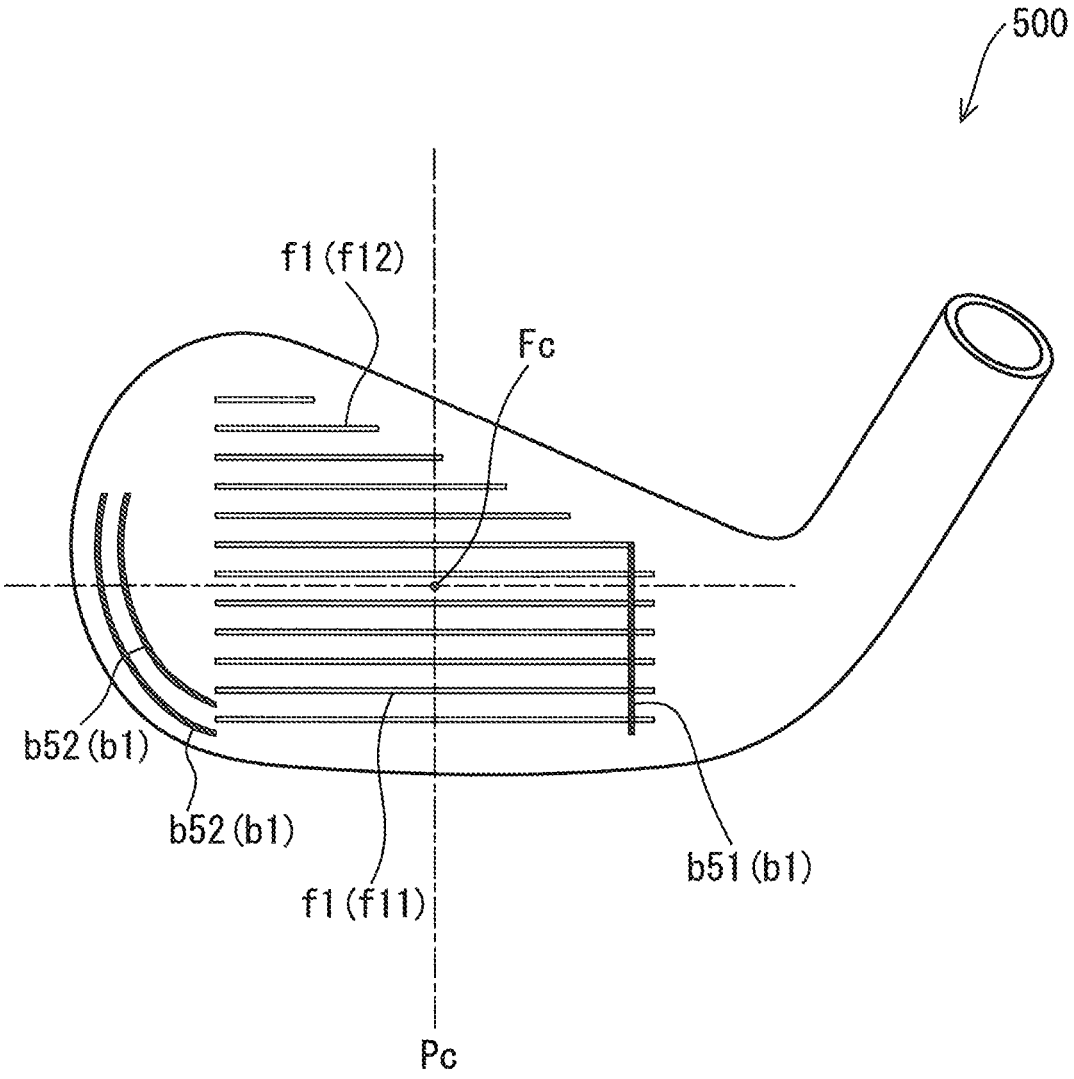
FIG. 12 is a front view of a head according to a fifth embodiment, and also shows back grooves with solid filled lines.

FIG. 12 is a front view (projected image) of a head 500 according to a fifth embodiment.

The head 500 includes, as a back groove b1, a back groove b51 located on the heel side relative to the face center Fc. The whole back groove b51 is located on the heel side relative to the face center Fc. The back groove b51 extends from the heel lower region Sh2 to the heel upper region Sh1. The back groove b51 extends along the up-down direction.

The back groove b51 intersects the score lines f1. Note that the intersection between the back groove b1 and the score lines f1 means intersection in the projected image. As shown in FIG. 12, the back groove b51 intersects seven score lines f1.

The head 500 includes, as a back groove b1, a back groove b52 located on the toe side relative to the face center Fc. The whole back groove b52 is located on the toe side relative to the face center Fc. The whole back groove b52 is located on the toe side relative to the toe-end position Pt (see FIG. 6). The back groove b52 extends from the toe lower out-of-line region St22 to the toe upper out-of-line region St12. The back groove b52 is curved. The back groove b52 is curved along the contour line of the head 500. The back groove b52 is curved so as to project toward the outside of the head 500. A plurality of (two) back grooves b52 are provided.

The back groove b1 is not present in the toe upper line region St10. The back groove b1 is not present in the toe lower line region St20. The back groove b1 is not present in the toe line region St30.

Figure 13A:
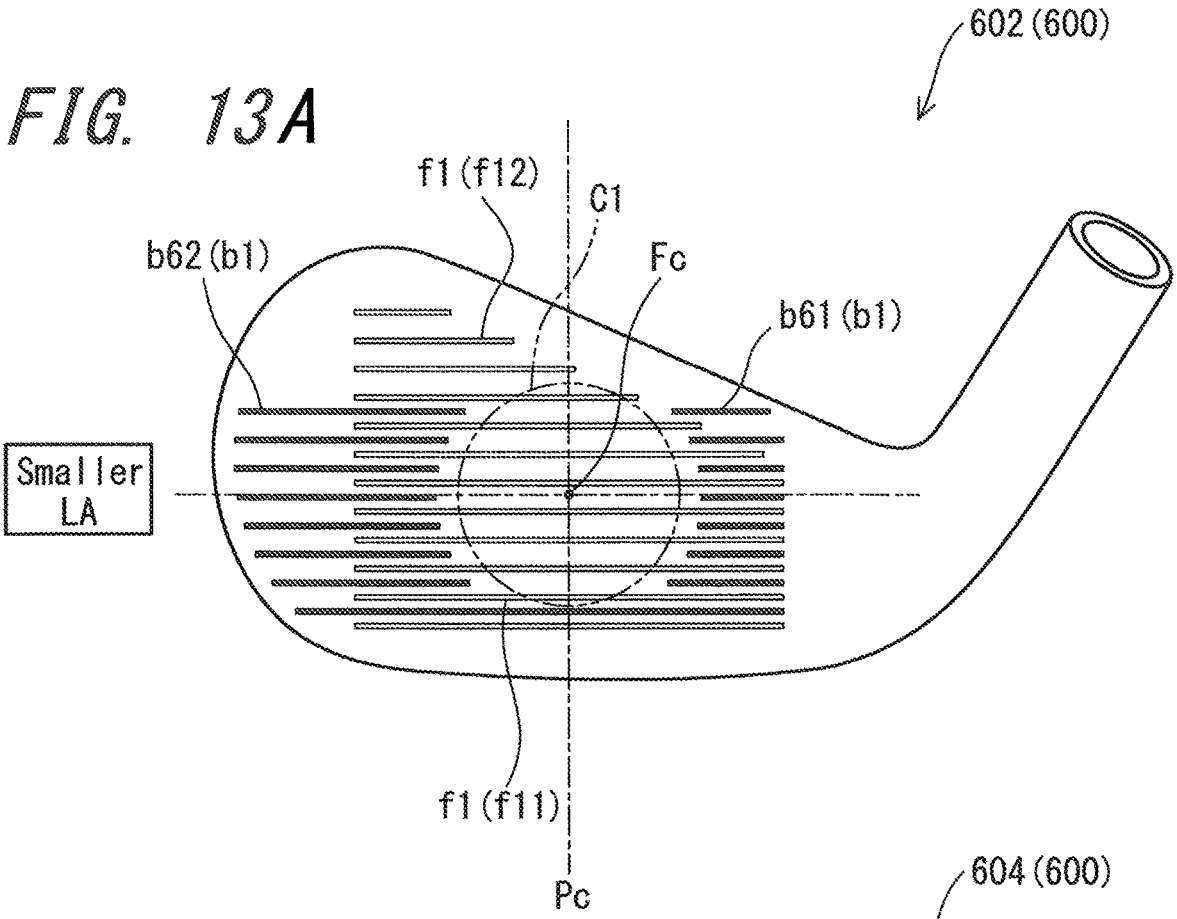
FIG. 13A is a front view of a head according to a sixth embodiment.
Figure 13B:
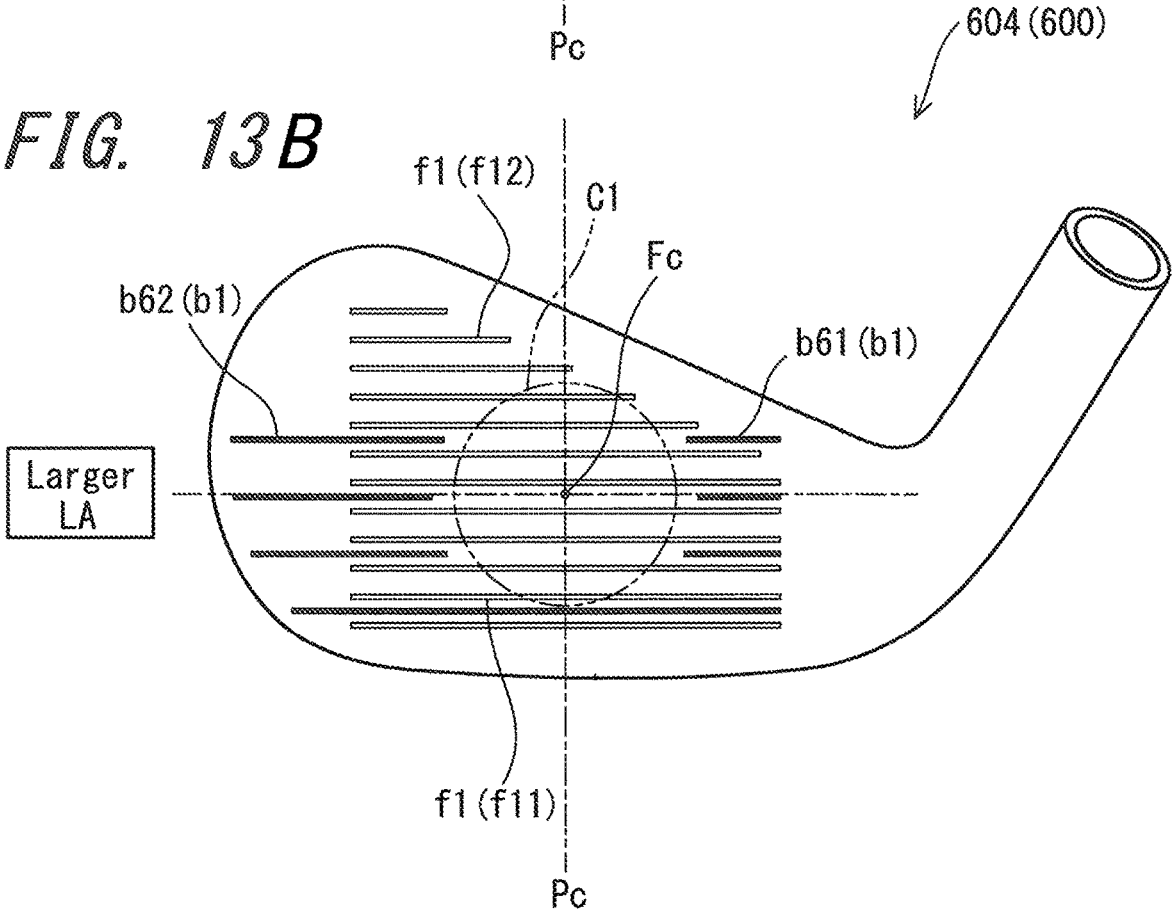
FIG. 13B is a front view of another head according to the sixth embodiment, and FIG. 13A and FIG. 13B also show back grooves with solid filled lines.

FIG. 13A shows a front view (projected image) of a head 602 according to a sixth embodiment. FIG. 13B is a front view (projected image) of a head 604 according to the sixth embodiment. The head 602 and the head 604 constitute a head set 600. The head 602 has a club number different from that of the head 604. The head 602 has a loft angle (real loft angle) different from that of the head 604. The loft angle (LA) of the head 602 is smaller than the loft angle (LA) of the head 604. The head set 600 is used for a golf club set.

The head 602 includes a plurality of back grooves b1. At least one back groove b1 is present in the heel upper region Sh1. At least one back groove b1 is present in the heel lower region Sh2. At least one back groove b1 is present in the toe upper region St1. At least one back groove b1 is present in the toe lower region St2.

In a circular region C1 whose center is the face center Fc, the back groove b1 is not present. The durability of a region having a high frequency of hittings can be improved by providing the circular region C1. In addition, a high rebound area can be enlarged by maintaining the rigidity of the vicinity of the face center Fc which has a high rebound performance and by reducing the rigidity of the circumference region thereof. The circular region C1 can have a radius of 10 mm. A distance between the face center Fc and a sweet spot SS may be the radius of the circular region C1. The sweet spot SS means an intersection point between the hitting surface and a straight line passing through the center of gravity of the head and perpendicular to the hitting surface.

Note that the back groove b1 is not present in the circular region C1 in other embodiments (the head 200, the head 300, the head 400, the head 500, and heads 702 and 704 described later), either.

The back grooves b1 include heel partial grooves b61 located on the heel side relative to the circular region C1, and toe partial grooves b62 located on the toe side relative to the circular region C1 and located on extended lines of the respective heel partial grooves b61. All the back grooves b1 are parallel to the score lines f1.

As shown in FIG. 13B, the head 604 includes a smaller number of back grooves b1 as compared with the head 602. In the head 604, some of the back grooves b1 in the head 602 are eliminated.

Figure 14A:
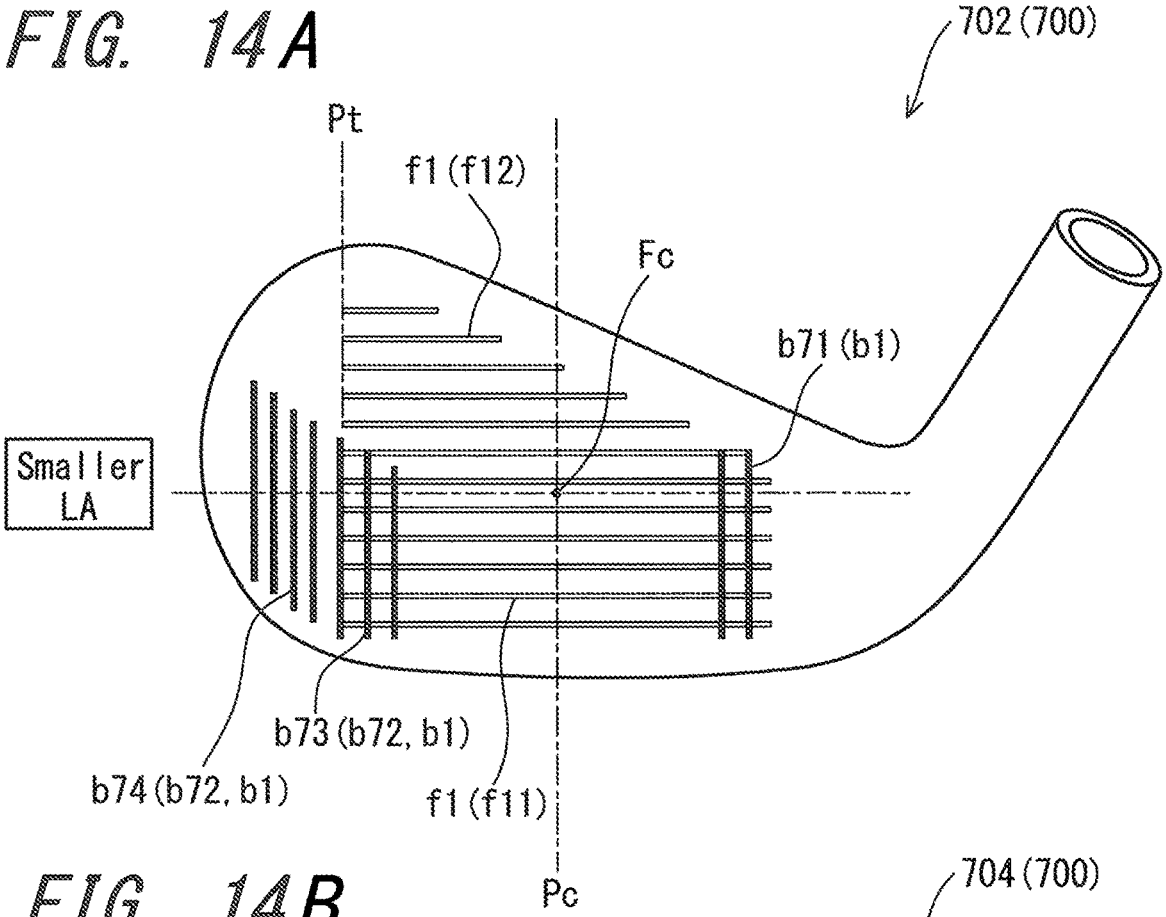
FIG. 14A is a front view of a head according to a seventh embodiment.
Figure 14B:
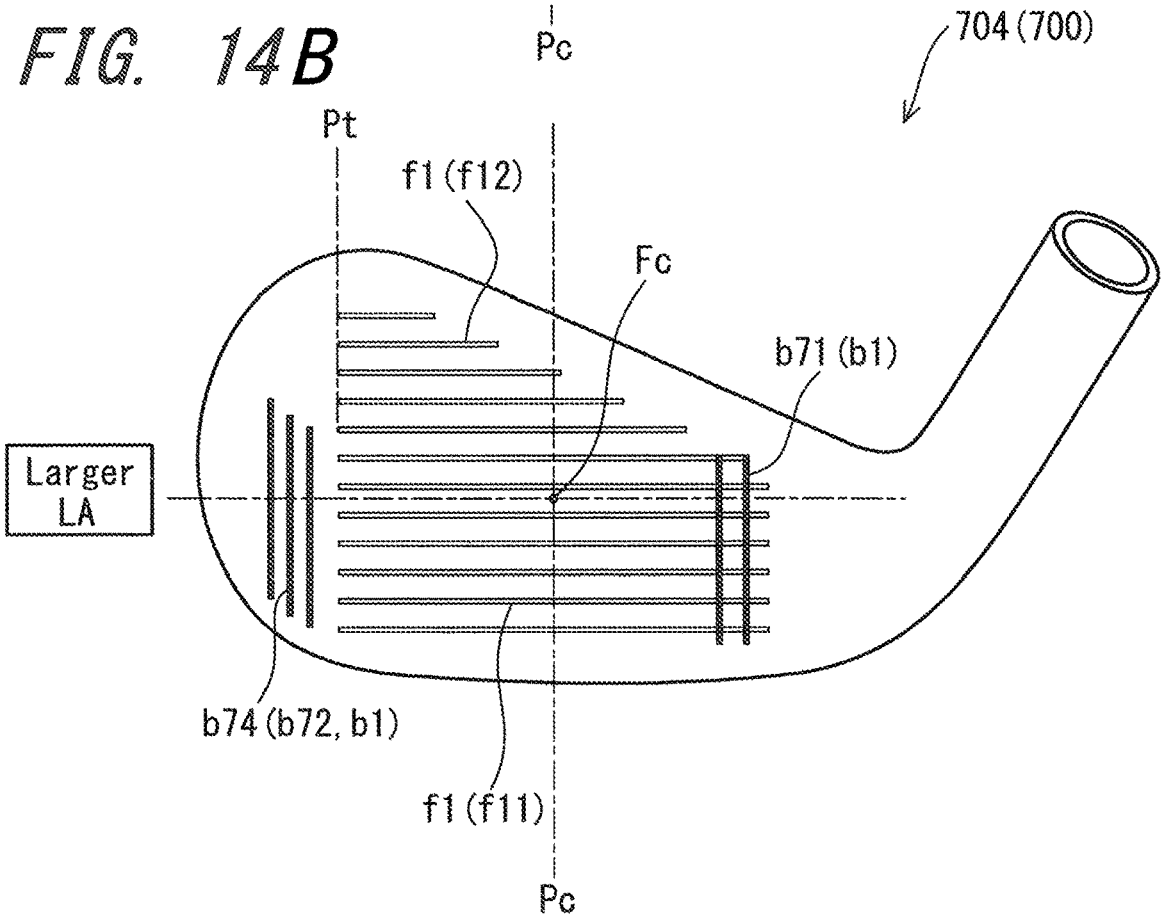
FIG. 14B is a front view of another head according to the seventh embodiment, and FIG. 14A and FIG. 14B also show back grooves with solid filled lines.

FIG. 14A is a front view (projected image) of a head 702 according to a seventh embodiment. FIG. 14B is a front view (projected image) of a head 704 according the seventh embodiment. The head 702 and the head 704 constitute a head set 700. The head 702 has a club number different from that of the head 704. The head 702 has a loft angle (real loft angle) different from that of the head 704. The loft angle (LA) of the head 702 is smaller than the loft angle (LA) of the head 704. The headset 700 is used for a golf club set.

The head 702 includes a plurality of back grooves b1. At least one back groove b1 is present in the heel upper region Sh1. At least one back groove b1 is present in the heel lower region Sh2. At least one back groove b1 is present in the toe upper region St1. At least one back groove b1 is present in the toe lower region St2. At least one back groove b1 is present in the toe upper line region St10. At least one back groove b1 is present in the toe lower line region St20. At least one back groove b1 is present in the toe upper out-of-line region St12. At least one back groove b1 is present in the toe lower out-of-line region St22. At least one back groove b1 is present in the toe line region St30.

The head 702 includes a back groove b71 located on the heel side relative to the face center Fc. The back groove b71 intersects the (seven) score lines f1. A plurality of (two) back grooves b71 are provided. The back grooves b71 extend along a straight line. The back grooves b71 extend in the up-down direction.

The head 702 includes back grooves b72 located on the toe side relative to the face center Fc. The back grooves b72 are located in the face toe region St. The back grooves b72 extend along a straight line. The back grooves b72 extend in the up-down direction.

The back grooves b72 include back grooves b73 located on the heel side relative to the toe-end position Pt, and back grooves b74 located on the toe side relative to the toe-end position Pt. The back grooves b73 are located in the toe line region St30. The back grooves b74 are located in the toe out-of-line region St32.

As shown in FIG. 14B, the head 704 includes a smaller number of back grooves b1 as compared with the head 702. In the head 704, some of the back grooves b1 in the head 702 are eliminated. In the head 704, the back grooves b73 in the head 702 are eliminated. In the head 704, the number of the back grooves b74 is reduced as compared with the head 702. In the head 704, the back groove b1 is not present in the toe line region St30. In the head 704, the back-groove projected area in the toe line region St30 is decreased as compared with the head 702. In the head 704, the back-groove projected area in the toe out-of-line region St32 is decreased as compared with the head 702.

In all of: the first embodiment (FIG. 8); the second embodiment (FIG. 9); the third embodiment (FIG. 10); the fourth embodiment (FIG. 11); the fifth embodiment (FIG. 12); the sixth embodiment (FIG. 13A and FIG. 13B); and the seventh embodiment (FIG. 14A and FIG. 14B), the back groove b1 is formed in at least two of the four regions. The four regions mean the heel upper region Sh1, the heel lower region Sh2, the toe upper region St1, and the toe lower region St2.

In the head 4 (FIG. 8) of the first embodiment, the back groove b1 is provided in the heel lower region Sh2 and the toe lower region St2, and is not provided in the heel upper region Sh1 or the toe upper region St1.

In the head 200 (FIG. 9) of the second embodiment, the back groove b1 is provided in the heel lower region Sh2, the toe lower region St2, and the toe upper region St1, and is not provided in the heel upper region Sh1. This holds true for the head 300 (FIG. 10) of the third embodiment and the head 400 (FIG. 11) of the fourth embodiment.

In the fifth embodiment (FIG. 12), the back groove b1 is provided in all the four regions. That is, the back groove b1 is provided in the toe upper region St1, the toe lower region St2, the heel upper region Sh1, and the heel lower region Sh2. This holds true for the heads 602 and 604 of the sixth embodiment and the heads 702 and 704 of the seventh embodiment.

By providing the back groove b1, the rigidity of the face part is reduced and the rebound performance is enhanced. By providing the back groove b1 at a portion in which an enhanced rebound performance is desired, the rebound performance of the portion can be enhanced.

In all the embodiments, the back-groove projected areas in at least two of the four regions St1, St2, Sh1, and Sh2 are different from each other. For example, in the first embodiment (FIG. 8), the back-groove projected area in the toe upper region St1 is different from the back-groove projected area in the toe lower region St2. In addition, the back-groove projected area in the heel upper region Sh1 is different from the back-groove projected area in the heel lower region Sh2. Furthermore, the back-groove projected area in the toe lower region St2 is different from the back-groove projected area in the heel lower region Sh2. As described above, the back-groove projected area in a region means the sum of the projected areas of all the back grooves b1 which are present in the region. The rebound performance in the region can be enhanced by increasing the back-groove projected area.

In all the embodiments, the back-groove projected areas in two regions each including at least one back groove b1 are different from each other. For example, in the first embodiment (FIG. 8), the back-groove projected area in the toe lower region St2 is different from the back-groove projected area in the heel lower region Sh2. The back-groove projected area in the toe lower region St2 is greater than the back-groove projected area in the heel lower region Sh2.

In all the embodiments, the back-groove occupation ratios in at least two of the four regions St1, St2, Sh1, and Sh2 are different from each other. For example, in the first embodiment (FIG. 8), the back-groove occupation ratio in the toe upper region St1 is different from the back-groove occupation ratio in the toe lower region St2. In addition, the back-groove occupation ratio in the heel upper region Sh1 is different from the back-groove occupation ratio in the heel lower region Sh2. Furthermore, the back-groove occupation ratio in the toe lower region St2 is different from the back-groove occupation ratio in the heel lower region Sh2. As described above, the back-groove occupation ratio in a region means the ratio of the back-groove projected area in the region to the whole area of the region. The rebound performance in the region can be enhanced by increasing the back-groove occupation ratio.

In all the embodiments, the back-groove occupation ratios in two regions each including at least one back groove b1 are different from each other. For example, in the first embodiment (FIG. 8), the back-groove occupation ratio in the toe lower region St2 is different from the back-groove occupation ratio in the heel lower region Sh2. The back-groove occupation ratio in the toe lower region St2 is greater than the back-groove occupation ratio in the heel lower region Sh2. The rebound performance can be improved in a region having a large back-groove occupation ratio.

The back-groove projected area in the region located on the lower side relative to the face center Fc may be greater than the back-groove projected area in the region located on the upper side relative to the face center Fc. In other words, the back-groove projected area in the face lower region S2 may be greater than the back-groove projected area in the face upper region S1. In this case, the rebound performance in the lower portion of the face can be improved. This constitution is particularly effective in a club used for hitting a ball placed directly on the ground (a ball which is not teed up). This constitution is preferable for an iron type head, a fairway wood type head, and a hybrid type head. The head 4 (FIG. 8), the head 200 (FIG. 9), the head 300 (FIG. 10), the head 400 (FIG. 11), the head 500 (FIG. 12), the head 602 (FIG. 13A), the head 604 (FIG. 13B), the head 702 (FIG. 14A), and the head 704 (FIG. 14B) include this constitution.

Similarly, the back-groove occupation ratio in the region located on the lower side relative to the face center Fc may be greater than the back-groove occupation ratio in the region located on the upper side relative to the face center Fc.

The back-groove projected area in the region located on the toe side relative to the face center Fc may be greater than the back-groove projected area in the region located on the heel side relative to the face center Fc. In other words, the back-groove projected area in the face toe region St may be greater than the back-groove projected area in the face heel region Sh. In this case, the rebound performance of the toe side can be improved. In an iron type head, etc., since the weight of a neck part is great, the center of gravity of the head tends to be located on the heel side relative to the face center Fc. For this reason, the rebound performance of the toe portion tends to be reduced. In a head in which the center of gravity of the head is located on the heel side relative to the face center Fc, the high rebound area can be effectively enlarged by enhancing the rebound performance of the toe region. The head 4 (FIG. 8), the head 200 (FIG. 9), the head 300 (FIG. 10), the head 400 (FIG. 11), the head 500 (FIG. 12), the head 602 (FIG. 13A), the head 604 (FIG. 13B), the head 702 (FIG. 14A), and the head 704 (FIG. 14B) include this constitution.

The back-groove occupation ratio in the region located on the toe side relative to the face center Fc may be greater than the back-groove occupation ratio in the region located on the heel side relative to the face center Fc.

The back groove b1 may be provided on the toe side relative to the toe-end position Pt (see FIG. 6). In other words, the back groove b1 may be provided in the toe out-of-line region St32. This constitution enhances the rebound performance of the toe region. Since the score lines f1 are not provided in the toe out-of-line region St32, strength reduction due to the presence of the back groove b1 can be alleviated. The head 4 (FIG. 8), the head 200 (FIG. 9), the head 300 (FIG. 10), the head 400 (FIG. 11), the head 500 (FIG. 12), the head 602 (FIG. 13A), the head 604 (FIG. 13B), and the head 702 (FIG. 14A) include this constitution.

The back groove b1 may be provided in the toe line region St30. This constitution enhances the rebound performance of the toe region. The score lines f1 are present in the toe line region St30. The synergistic effect of the score lines f1 and the back groove b1 effectively reduces the rigidity of the face part and enhances the rebound performance. The head 4 (FIG. 8), the head 200 (FIG. 9), the head 300 (FIG. 10), the head 400 (FIG. 11), the head 602 (FIG. 13A), the head 604 (FIG. 13B), the head 702 (FIG. 14A), and the head 704 (FIG. 14B) include this constitution.

The back groove b1 may be provided in the toe lower line region St20 (see FIG. 6). This constitution enhances the rebound performance of the toe lower region. The rebound performance of the toe lower region is enhanced by the synergistic effect of the back groove b1 located in the toe lower line region St20 and the score lines f1 located in the region St20. The head 4 (FIG. 8), the head 200 (FIG. 9), the head 300 (FIG. 10), the head 400 (FIG. 11), the head 602 (FIG. 13A), the head 604 (FIG. 13B), and the head 702 (FIG. 14A) include this constitution.

The back groove b1 may be provided in the toe lower out-of-line region St22 (see FIG. 6). This constitution further enhances the rebound performance of the toe lower region. The head 4 (FIG. 8), the head 200 (FIG. 9), the head 300 (FIG. 10), the head 400 (FIG. 11), the head 500 (FIG. 12), the head 602 (FIG. 13A), the head 604 (FIG. 13B), the head 702 (FIG. 14A) and the head 704 (FIG. 14B) include this constitution.

The back-groove projected area in the toe lower line region St20 may be greater than the back-groove projected area in the toe upper line region St10. In this case, the rebound performance of the toe lower side can be improved. The head 4 (FIG. 8), the head 200 (FIG. 9), the head 300 (FIG. 10), the head 400 (FIG. 11), the head 602 (FIG. 13A), the head 604 (FIG. 13B), and the head 702 (FIG. 14A) include this constitution.

The back-groove occupation ratio in the toe lower line region St20 may be greater than the back-groove occupation ratio in the toe upper line region St10.

The back-groove projected area in the toe lower out-of-line region St22 may be greater than the back-groove projected area in the toe upper out-of-line region St12. In this case, the rebound performance of the toe lower side can be improved. The head 4 (FIG. 8), the head 300 (FIG. 10), the head 400 (FIG. 11), the head 500 (FIG. 12), the head 602 (FIG. 13A), the head 604 (FIG. 13B), the head 702 (FIG. 14A) and the head 704 (FIG. 14B) include this constitution.

The back-groove occupation ratio in the toe lower out-of-line region St22 may be greater than the back-groove occupation ratio in the toe upper out-of-line region St12.

The back-groove projected area in the heel lower region Sh2 may be greater than the back-groove projected area in the heel upper region Sh1. In this case, the rebound performance of the heel lower side can be improved. The head 4 (FIG. 8), the head 200 (FIG. 9), the head 300 (FIG. 10), the head 400 (FIG. 11), the head 500 (FIG. 12), the head 602 (FIG. 13A), the head 604 (FIG. 13B), the head 702 (FIG. 14A) and the head 704 (FIG. 14B) include this constitution.

The back-groove occupation ratio in the heel lower region Sh2 may be greater than the back-groove occupation ratio in the heel upper region Sh1.

The back-groove total length in the region located on the lower side relative to the face center Fc may be greater than the back-groove total length in the region located on the upper side relative to the face center Fc. In other words, the back-groove total length in the face lower region S2 may be greater than the back-groove total length in the face upper region S1. In this case, the rebound performance in the lower portion of the face can be improved. The head 4 (FIG. 8), the head 200 (FIG. 9), the head 300 (FIG. 10), the head 400 (FIG. 11), the head 500 (FIG. 12), the head 602 (FIG. 13A), the head 604 (FIG. 13B), the head 702 (FIG. 14A) and the head 704 (FIG. 14B) include this constitution.

Note that the back-groove total length in a region means the sum of lengths of all the back grooves which are present in the region.

The back-groove total length in the region located on the toe side relative to the face center Fc may be greater than the back-groove total length in the region located on the heel side relative to the face center Fc. In other words, the back-groove total length in the face toe region St may be greater than the back-groove total length in the face heel region Sh. In this case, the rebound performance of the toe side of the face can be improved. The head 4 (FIG. 8), the head 200 (FIG. 9), the head 300 (FIG. 10), the head 400 (FIG. 11), the head 500 (FIG. 12), the head 602 (FIG. 13A), the head 604 (FIG. 13B), the head 702 (FIG. 14A) and the head 704 (FIG. 14B) include this constitution.

The back groove b1 may be disposed so as not to overlap the score lines f1. In the head 4 (FIG. 8), each back groove b1 is located on each interval between adjacent score lines f1, and do not overlap the score lines f1. The overlap means an overlap of the back groove b1 and the score lines f1 in the above-described projected image. This overlap is a concept that includes the above-described intersection between the back groove b1 and the score lines f1. In a portion in which the score line f1 and the back groove b1 overlap each other, the face part becomes thin and the strength can be reduced. By avoiding the overlap, the strength reduction is suppressed and durability is improved. Therefore, the durability can be improved while reducing the rigidity.

The back groove b1 may overlap the score lines f1. Although the strength of the portion in which the score line f1 overlaps the back groove b1 can be reduced, the rigidity of the face can be decreased. This decrease in the rigidity can contribute to rebound performance. In the head 500 (FIG. 12), the head 702 (FIG. 14A) and the head 704 (FIG. 14B), the back groove b1 overlaps the score lines f1.

As described above, the head 4 includes the plurality of quadrangular regions R (see FIG. 7). In the head 4, twelve score lines f1 are provided and eleven quadrangular regions R are present. This holds true for the other all embodiments.

In light of easy explanation, the eleven quadrangular regions R are represented by R1, R2, R3, R4, R5, R6, R7, R8, R9, R10, and R11 in order from the region located on the uppermost (see FIG. 7). Of the eleven quadrangular regions R, the quadrangular region R1 does not include the heel partial region Rh. The quadrangular regions R2 to R11 each include the heel partial region Rh and the toe partial region Rt.

In each of the quadrangular regions R, the area of the quadrangular region R is represented by Ra, and the back-groove projected area thereof is represented by Ga. When two or more back grooves b1 are present in one quadrangular region R, the area Ga is the sum total of the projected areas of those back grooves b1.

As shown in FIG. 8, five back grooves b1 are provided in the head 4. Each of the back grooves b1 is provided in each quadrangular region R. Each of the back grooves b1 is provided in the quadrangular region R7, the quadrangular region R8, the quadrangular region R9, the quadrangular region R10 and the quadrangular region R11, individually. In the quadrangular region R7 to the quadrangular region R11, the respective areas Ra are the same and the respective areas Ga are also the same. Therefore, in the quadrangular region R7 to the quadrangular region R11, respective Ga/Ra values are the same. In each of the quadrangular regions R1 to R6, the area Ga is zero, and Ga/Ra is also zero.

In the head 4, the Ga/Ra values in at least two of the quadrangular regions are different from each other. For example, Ga/Ra of the quadrangular region R6 is zero, whereas Ga/Ra of the quadrangular region R11 is greater than zero. In the quadrangular region R having a large Ga/Ra, the rebound performance is enhanced.

In the head 4, the quadrangular regions R located on the upper side relative to the face center Fc are the quadrangular regions R1, R2, R3, R4, R5 and R6. In the head 4, the quadrangular regions R located on the lower side relative to the face center Fc are the quadrangular regions R8, R9, R10 and R11. Note that the quadrangular region R7 includes the face center Fc. This quadrangular region R7 is not included in either the quadrangular regions R located on the upper side relative to the face center Fc, or the quadrangular regions R located on the lower side relative to the face center Fc.

In the head 4, the minimum value of the Ga/Ra values in the lower side relative to the face center Fc is greater than the maximum value of the Ga/Ra values in the upper side relative to the face center Fc. This constitution can enhance the rebound performance of the lower portion of the face.

In the head 4, since four quadrangular regions R are present on the lower side relative to the face center Fc, the number of the Ga/Ra values is also four. The minimum value of these four Ga/Ra values is the minimum value of the Ga/Ra values in the lower side relative to the face center Fc. In the head 4, since all of the four Ga/Ra values are the same value (to be represented by V1), the minimum value is also V1.

In the head 4, since six quadrangular regions R are present on the upper side relative to the face center Fc, the number of the Ga/Ra values is also six. The maximum value of these six Ga/Ra values is the maximum value of the Ga/Ra values in the upper side relative to the face center Fc. In the head 4, since all of the six Ga/Ra values are zero, the maximum value is also zero.

In each of the quadrangular regions R, the area of the toe partial region Rt is represented by Rb, and the back-groove projected area in the toe partial region Rt is represented by Gb. In each of the quadrangular regions R, the area of the heel partial region Rh is represented by Rc, and the back-groove projected area in the heel partial region Rh is represented by Gc.

In the head 4, Gb/Rb is equal to Gc/Rc in all the quadrangular regions R. In the quadrangular regions R1 to R6, Gb/Rb is zero, and Gc/Rc is also zero. In the quadrangular regions R7 to R11, Gb/Rb and Gc/Rc are equal to V1 described above.

Figure 15:
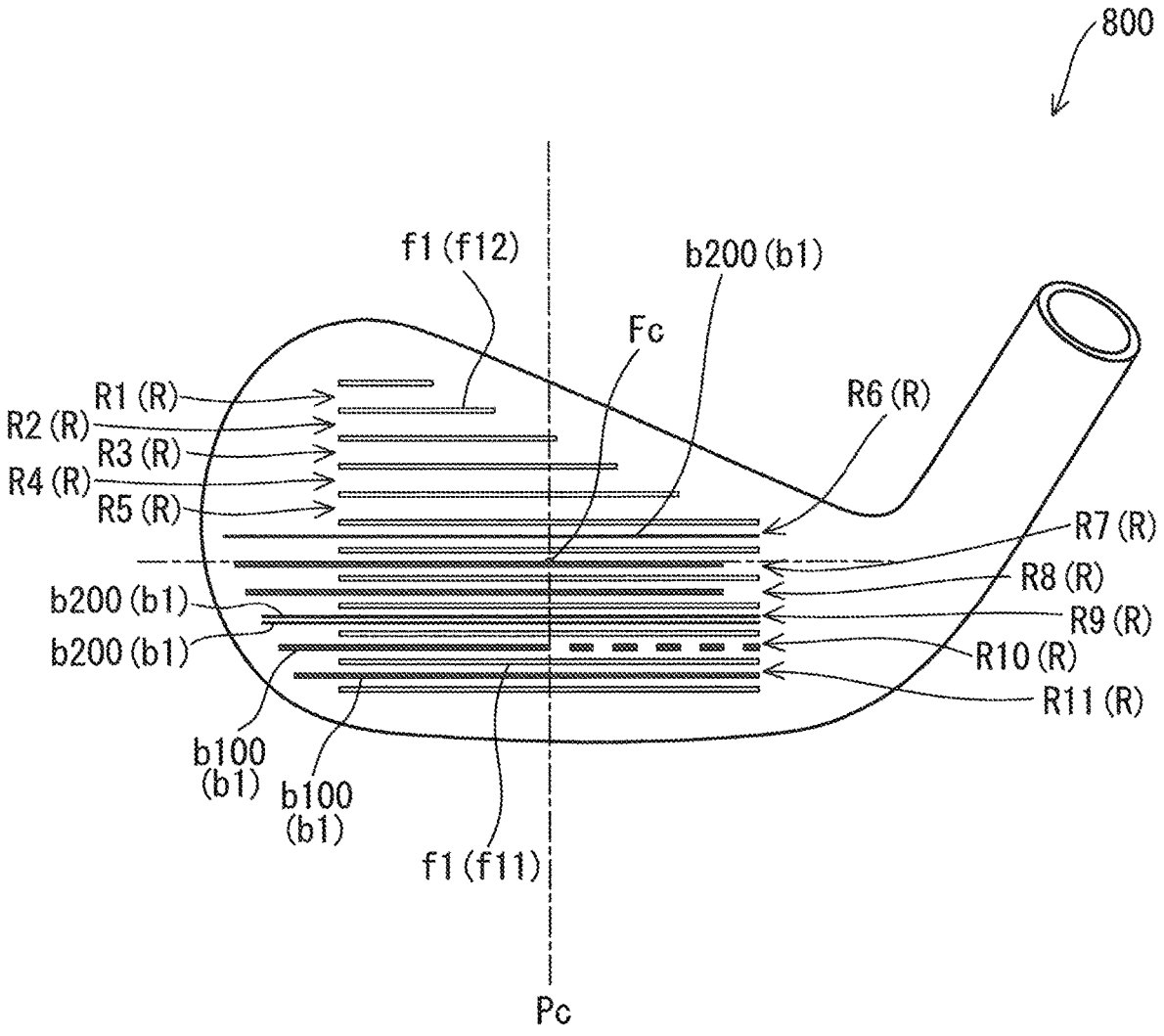
FIG. 15 is a front view of a head according to an eighth embodiment, and also shows back grooves with solid filled lines.

FIG. 15 is a front view (projected image) of a head 800 according to an eighth embodiment. In the head 800, the back groove b1 is provided in at least one quadrangular region R located on the upper side relative to the face center Fc. In the head 800, the back groove b1 is provided in at least one quadrangular region R located on the lower side relative to the face center Fc.

The head 800 includes a thick back groove b100 and a thin back groove b200 as the back grooves b1. The thick back groove b100 is thicker than the thin back groove b200.

The thin back groove b200 is provided in the quadrangular region R6 located on the upper side relative to the face center Fc. The thin back groove b200 is also provided in the quadrangular region R9 located on the lower side relative to the face center Fc. In the quadrangular region R9, two thin back grooves b200 are provided. The thick back groove b100 is provided in the quadrangular regions R8, R10, and R11 which are located on the lower side relative to the face center Fc. The Ga/Ra value of the quadrangular region R6 is the minimum except the Ga/Ra values in which the area Ga is zero.

In the head 800, the minimum value of the Ga/Ra values in the lower side relative to the face center Fc is the Ga/Ra value of the quadrangular region R9. In the head 800, the maximum value of the Ga/Ra values in the upper side relative to the face center Fc is the Ga/Ra value of the quadrangular region R6. Also in the head 800, the minimum value of the Ga/Ra values in the lower side relative to the face center Fc is greater than the maximum value of the Ga/Ra values in the upper side relative to the face center Fc. This constitution can enhance the rebound performance of the lower portion of the face.

In the head 800, the Ga/Ra values of two of the quadrangular regions R which include the back groove b1 are different from each other. For example, Ga/Ra of the quadrangular region R6 differs from Ga/Ra of the quadrangular region R11. This difference is caused by the thicknesses of the back grooves b1. This difference in Ga/Ra makes difference in rebound performance between the respective quadrangular regions R. The quadrangular region R6 having a smaller Ga/Ra is located on the upper side relative to the face center Fc, whereas the quadrangular region R11 having a larger Ga/Ra is located on the lower side relative to the face center Fc. This constitution can contribute to improvement in rebound performance of the lower portion of the face. This constitution is particularly effective in a club used for hitting a ball placed directly on the ground (a ball which is not teed up). This constitution is preferable for an iron type head, a fairway wood type head, and a hybrid type head.

In the quadrangular region R7, Gb/Rb is different from Gc/Rc. This difference is caused by the lengths of the back grooves b1. The back groove b1 in the quadrangular region R7 ends while not extending to the heel end of the heel partial region Rh. The Gb/Rb is greater than the Gc/Rc. This holds true for the quadrangular region R8. The rebound performance of the toe side of the face can be improved by making Gb/Rb greater than Gc/Rc. In an iron type head, etc., since the weight of the neck part is great, the center of gravity of the head tends to be located on the heel side relative to the face center Fc. For this reason, the rebound performance of the toe portion tends to be reduced. In the head in which the center of gravity of the head is located on the heel side relative to the face center Fc, the high rebound area can be effectively enlarged by enhancing the rebound performance of the toe region.

In the head 800, the quadrangular regions R having Gb/Rb greater than Gc/Rc are the quadrangular regions R7, R8 and R10. The quadrangular regions R having Gb/Rb equal to Gc/Rc are the quadrangular regions R2, R3, R4, R5, R6 and R9. The quadrangular region R having Gb/Rb smaller than Gc/Rc is not present.

Also in the quadrangular region R10, Gb/Rb is greater than Gc/Rc. In the quadrangular region R10, the back groove b1 in the toe partial region Rt is continuous, whereas the back groove b1 in the heel partial region Rh is discontinuous. As a result, Gb/Rb is greater than Gc/Rc.

Thus, in light of enhancing the rebound performance of the toe region, Gb/Rb may be greater than Gc/Rc in at least one quadrangular region R.

The quadrangular regions R7, R8, R10 having Gb/Rb greater than Gc/Rc are located on the lower side relative to the face center Fc. This constitution contributes to improvement in the rebound performance of the toe lower side of the face.

The average value A2 of the Ga/Ra values of all the quadrangular regions R located on the lower side relative to the face center Fc may be greater than the average value A1 of the Ga/Ra values of all the quadrangular regions R located on the upper side relative to the face center Fc. This constitution can contribute to improvement in the rebound performance of the lower portion of the face. For example, in the embodiment of FIG. 15, the quadrangular regions R located on the lower side relative to the face center Fc are the quadrangular regions R8, R9, R10 and R11. Therefore, the average value A2 is the average value of the Ga/Ra values of these four regions. In the embodiment of FIG. 15, the quadrangular regions R located on the upper side relative to the face center Fc are the quadrangular regions R1, R2, R3, R4, R5 and R6. Therefore, the average value A1 is the average value of the Ga/Ra values of these six regions.

The average value T1 of the Gb/Rb values in all the toe partial regions Rt may be greater than the average value H1 of the Gc/Rc values in all the heel partial regions Rh. This constitution can contribute to improvement in the rebound performance of the toe side of the face. For example, in the embodiment of FIG. 15, all of the quadrangular regions R include the respective toe partial regions Rt, and thus eleven toe partial regions Rt are present. Therefore, the average value T1 is the average value of the eleven Gb/Rb values. In the embodiment of FIG. 15, the quadrangular regions R2 to R11 include the respective heel partial regions Rh, and thus ten heel partial regions Rh are present. Therefore, the average value H1 is the average value of the ten Gc/Rc values.

A plurality of back grooves b1 may be provided in one quadrangular region R. In the embodiment of FIG. 15, the back groove b1 in the heel partial region Rh of the quadrangular region R10 is discontinuous. As a result, a plurality of (five) back grooves b1 are provided in the quadrangular region R10. On the other hand, two back grooves b1 arranged side by side in the up-down direction are provided in the quadrangular region R9. As a result, the plurality of (two) back grooves b1 are provided in the quadrangular region R9. By providing such plurality of back grooves b1 in one quadrangular region R, stress concentration in face deformation can be alleviated.

Figure 16:
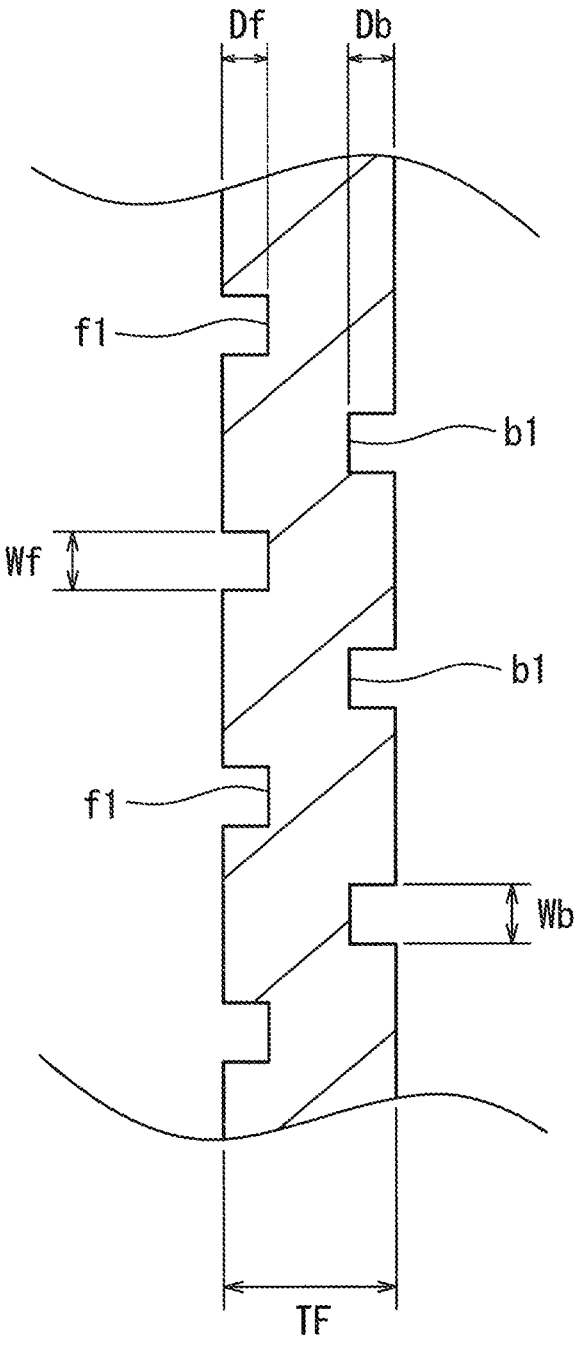
FIG. 16 is an enlarged sectional view showing an example of a face part.

FIG. 16 is an enlarged sectional view showing one example of the face part.

A double-pointed arrow Wf in FIG. 16 shows a width (mm) of the score lines f1. The width Wf is an opening width. The width Wf is measured along the up-down direction. The 30 degree method of measurement defined in the Golf Rules announced by the R&A can be applied to the measurement of the width Wf.

A double-pointed arrow Df in FIG. 16 shows a depth (mm) of the score lines f1. The depth Df is measured along the direction perpendicular to the hitting surface (face perpendicular direction).

A double-pointed arrow Wb in FIG. 16 shows a width (mm) of the back groove b1. The width Wb is an opening width. The width Wb is measured along the up-down direction. The 30 degree method of measurement defined in the Golf Rules announced by the R&A can be diverted to the measurement of the width Wb.

A double-pointed arrow Db in FIG. 16 shows a depth (mm) of the back groove b1. The depth Db is measured along the direction perpendicular to the hitting surface (face perpendicular direction).

A double-pointed arrow TF in FIG. 16 shows a face thickness (mm). The face thickness TF is measured along the direction perpendicular to the hitting surface (face perpendicular direction).

The width Wb of the back groove b1 is preferably less than three times the width Wf of the score lines f1. In this case, the overlap between the back groove b1 and the score lines f1 can be prevented.

In light of the durability of the face part, the depth Db of the back groove b1 is preferably less than or equal to half the face thickness TF.

In at least one of the quadrangular regions R, the average value of the depths Df of the score lines f1 located on the both sides of the quadrangular region R is represented by Df1, and the average value of the depths Db of the back grooves b1 disposed in the quadrangular region R is represented by Db1. When the number of the back grooves b1 disposed in the quadrangular region R is one, the average value Db1 is the depth Db of the back groove b1. In this case, the sum of Df1 and Db1 is preferably smaller than the face thickness TF in the quadrangular region R. That is, it is preferable that (Df1+Db1)<TH is satisfied in at least one of the quadrangular regions R. More preferably, (Df1+Db1) <TF is satisfied in all the quadrangular regions R which include the back groove b1. This constitution can contribute to the durability of the face part.

The depth Db of the back groove b1 may be greater than the depth Df of the score lines f1. This constitution is effective for improvement in rebound performance.

In light of enhancing the effects brought by the back groove b1, the face thickness TF is preferably less than or equal to 5 mm, more preferably less than or equal to 4 mm, and still more preferably less than or equal to 3.5 mm. In light of the strength of the face part, the face thickness TF is preferably greater than or equal to 1.5 mm, more preferably greater than or equal to 1.8 mm, and still more preferably greater than or equal to 2 mm.

In light of rebound performance, the depth Db of the back groove b1 is preferably greater than or equal to 0.4 mm, more preferably greater than or equal to 0.8 mm, and still more preferably greater than or equal to 1.2 mm. In light of the strength of the face part, the depth Db is preferably less than or equal to 2.4 mm, more preferably less than or equal to 2.2 mm, and still more preferably less than or equal to 2.0 mm.

Figure 17:
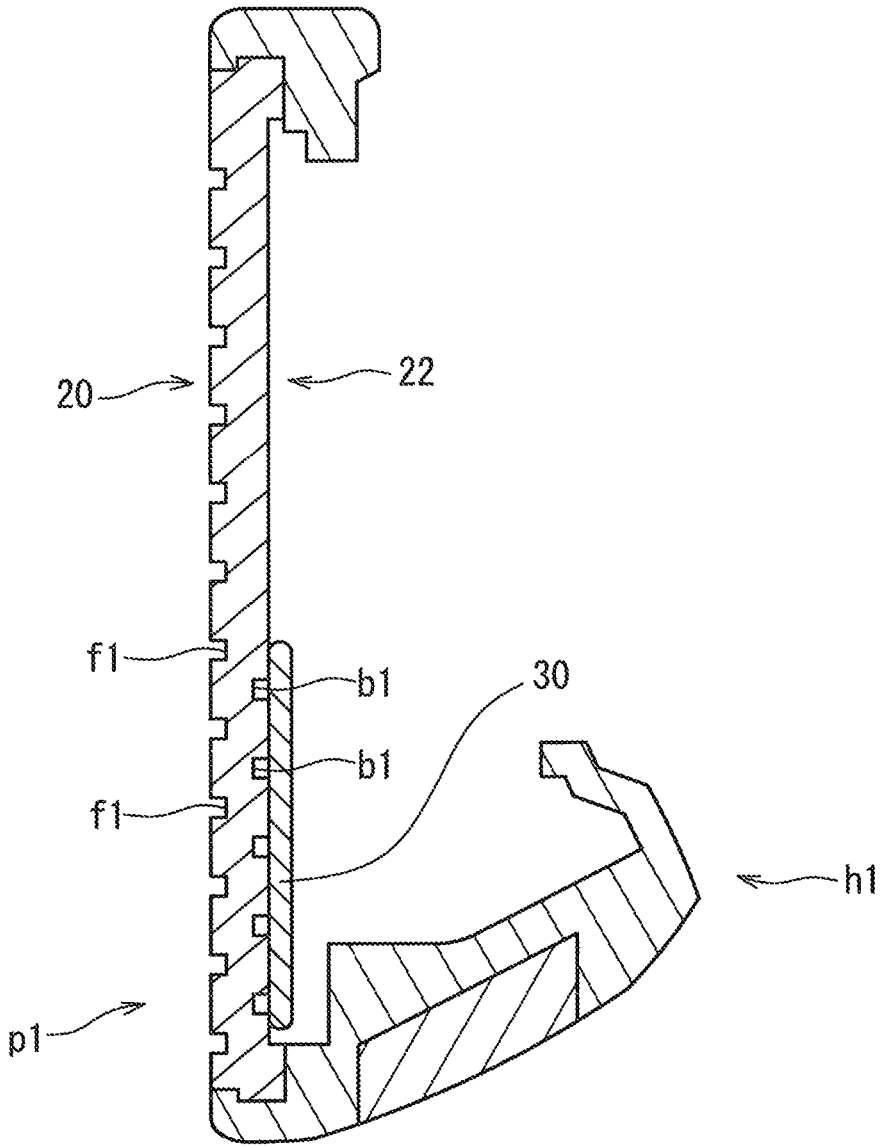
FIG. 17 is a sectional view of an embodiment that includes a cover member.

A cover member that covers at least one back groove b1 may be provided on the face back surface. FIG. 17 is a sectional view showing one example of the cover member. The cover member 30 covers all the plurality of back grooves b1. As the cover member 30, what is generally referred to as a badge can be used. Examples of the material of the cover member 30 include a resin and a metal. The cover member 30 is applied to the face back surface 22 by using a double-sided adhesive tape or a glue, for example. The cover member contributes to improvement in appearance.

The loft angle of the head is not limited. As described above, the constitution of the present disclosure is useful for improvement in rebound performance. The improvement of rebound performance is particularly effective in a club having a small loft angle. In this respect, the loft angle (real loft angle) is preferably less than or equal to 35 degrees. Note that the loft angle is normally greater than or equal to seven degrees.

The type of the head is not limited. Examples of the type of the head include an iron type head, a wood type head, and a hybrid type head.

As described above, FIG. 13A and FIG. 13B show the head set 600 used for a golf club set. FIG. 14A and FIG. 14B show the head set 700 used for a golf club set.

Each head set includes two or more heads having a loft angle different from each other. The head set is used for an iron type golf club set. The number of clubs of the club set (the number of the heads of the head set) can be two or more, further, can be three or more, or furthermore, can be four or more. The number of the clubs of the club set (the number of the heads of the head set) can be ten or less, further, can be nine or less, or furthermore, can be eight or less. Preferably, in the club set, the greater the loft angle is, the shorter the club length is.

The head set 600 and the head set 700 satisfy the following relationship (a):

(a) The smaller the loft angle is, the greater the back-groove projected area in the whole face part is.

In the set satisfying the relationship (a), flight distance can be further improved as the club number becomes smaller. That is, flight distance can be improved in clubs in which greater flight distance is desired.

The head set 600 and the head set 700 satisfy the following relationship (b):

(b) The smaller the loft angle is, the greater the back-groove occupation ratio in the whole face part is.

In the set satisfying the relationship (b), flight distance can be further improved as the club number becomes smaller. That is, flight distance can be improved in clubs in which greater flight distance is desired.

The head set 600 and the head set 700 satisfy the following relationship (c):

(c) The smaller the loft angle is, the greater the average value of the Ga/Ra values of all the quadrangular regions R.

Each of the heads 602, 604, 702 and 704 includes 11 quadrangular regions R. Therefore, the average value of the Ga/Ra values of all the quadrangular regions R is the average value of the 11 Ga/Ra values.

In the set satisfying the relationship (c), flight distance can be further improved as the club number becomes smaller. That is, flight distance can be improved in clubs in which greater flight distance is desired.

As to the above-described embodiments, the following clauses are disclosed.

[Clause 1]

A golf club head comprising: a face part, a sole part, and a hosel part, wherein the face part includes a hitting surface and a face back surface, a plurality of score lines are formed on the hitting surface, one or two or more back grooves are formed on the face back surface, and when the face part is divided into four regions: a toe upper region; a toe lower region; a heel upper region; and a heel lower region, with reference to a face center, back-groove projected areas of at least two regions of the four regions are different from each other.

[Clause 2]

The golf club head according to the clause 1, wherein back-groove occupation ratios of at least two regions of the four regions are different from each other.

[Clause 3]

The golf club head according to the clause 1 or 2, wherein the back-groove projected area in a region located on a lower side relative to the face center is greater than the back-groove projected area in a region located on an upper side relative to the face center.

[Clause 4]

The golf club head according to any one of the clauses 1 to 3, wherein the back-groove projected area in a region located on a toe side relative to the face center is greater than the back-groove projected area in a region located on a heel side relative to the face center.

[Clause 5]

The golf club head according to any one of the clauses 1 to 4, wherein the back groove is disposed so as not to overlap the score lines.

[Clause 6]

The golf club head according to the clause 5, wherein there are a plurality of quadrangular regions each having two of the score lines adjacent to each other as a top side and a bottom side thereof, in each of the quadrangular regions, an area of the quadrangular region is represented by Ra, and the back-groove projected area is represented by Ga, and Ga/Ra values of at least two of the quadrangular regions are different from each other.

[Clause 7]

The golf club head according to the clause 6, wherein a minimum value of the Ga/Ra values in a lower side relative to the face center is greater than a maximum value of the Ga/Ra values in an upper side relative to the face center.

[Clause 8]

The golf club head according to the clause 6 or 7, wherein of each of the quadrangular regions, a portion located on a toe side relative to the face center is denoted as a toe partial region, of each of the quadrangular regions, a portion located on a heel side relative to the face center is denoted as a heel partial region, an area of the toe partial region is represented by Rb, and the back-groove projected area in the toe partial region is represented by Gb, an area of the heel partial region is represented by Rc, and the back-groove projected area in the heel partial region is represented by Gc, and Gb/Rb is greater than Gc/Rc in at least one of the quadrangular regions.

The above descriptions are merely illustrative examples, and various modifications can be made in the scope not to depart from the principles of the present disclosure.

What is claimed is:

1. A golf club head comprising:

a face part;

a sole part; and a hosel part, wherein:

the face part includes a hitting surface and a face back surface;

a plurality of score lines are formed on the hitting surface;

one or two or more back grooves are formed on the face back surface;

with reference to a face center, the face part is divided into four regions: a toe upper region; a toe lower region; a heel upper region; and a heel lower region;

back-groove projected areas of at least two regions of the four regions are different from each other; and the back-groove projected area in a region located on a lower side relative to the face center is greater than the back-groove projected area in a region located on an upper side relative to the face center.

2. The golf club head according to claim 1, wherein back-groove occupation ratios of at least two regions of the four regions are different from each other.

3. A golf club head comprising:

a face part;

a sole part; and a hosel part, wherein:

the face part includes a hitting surface and a face back surface;

a plurality of score lines are formed on the hitting surface;

one or two or more back grooves are formed on the face back surface;

with reference to a face center, the face part is divided into four regions: a toe upper region; a toe lower region; a heel upper region; and a heel lower region;

back-groove projected areas of at least two regions of the four regions are different from each other; and the back-groove projected area in a region located on a toe side relative to the face center is greater than the back-groove projected area in a region located on a heel side relative to the face center.

4. A golf club head comprising:

a face part;

a sole part; and a hosel part, wherein:

the face part includes a hitting surface and a face back surface;

a plurality of score lines are formed on the hitting surface;

one or two or more back grooves are formed on the face back surface;

with reference to a face center, the face part is divided into four regions: a toe upper region; a toe lower region; a heel upper region; and a heel lower region;

back-groove projected areas of at least two regions of the four regions are different from each other;

the back groove is disposed so as not to overlap the score lines, there are a plurality of quadrangular regions, each quadrangular region having two of the score lines adjacent to each other as a top side and a bottom side of the quadrangular region;

in each of the quadrangular regions, an area of the quadrangular region is represented by Ra, and the back-groove projected area is represented by Ga; and Ga/Ra values of at least two of the quadrangular regions are different from each other.

5. The golf club head according to claim 4, wherein a minimum value of the Ga/Ra values in a lower side relative to the face center is greater than a maximum value of the Ga/Ra values in an upper side relative to the face center.

6. The golf club head according to claim 4, wherein of each of the quadrangular regions, a portion located on a toe side relative to the face center is denoted as a toe partial region, of each of the quadrangular regions, a portion located on a heel side relative to the face center is denoted as a heel partial region, an area of the toe partial region is represented by Rb, and the back-groove projected area in the toe partial region is represented by Gb, an area of the heel partial region is represented by Rc, and the back-groove projected area in the heel partial region is represented by Gc, and Gb/Rb is greater than Gc/Rc in at least one of the quadrangular regions.

7. A golf club head comprising:

a face part;

a sole part; and a hosel part, wherein:

the face part includes a hitting surface and a face back surface;

a plurality of score lines are formed on the hitting surface;

one or two or more back grooves are formed on the face back surface;

with reference to a face center, the face part is divided into four regions: a toe upper region; a toe lower region; a heel upper region; and a heel lower region;

back-groove projected areas of at least two regions of the four regions are different from each other;

a toe-heel direction position of toe-side ends of the score lines is defined as a toe-end position, of the toe upper region, a region located on a toe side relative to the toe-end position is defined as a toe upper out-of-line region, of the toe lower region, a region located on the toe side relative to the toe-end position is defined as a toe lower out-of-line region, a region constituted by the toe upper out-of-line region and the toe lower our-of-line region is defined as a toe out-of-line region, and the back groove is provided in the toe out-of-line region.

8. The golf club head according to claim 7, wherein the back-groove projected area in the toe lower out-of-line region is greater than the back-groove projected area in the toe upper out-of-line region.

9. The golf club head according to claim 7, wherein a back-groove occupation ratio in the toe lower out-of-line region is greater than a back-groove occupation ratio in the toe upper out-of-line region.

10. The golf club head according to claim 1, wherein the back groove includes a straight portion and a curved portion extending from a toe-side end of the straight portion.

11. The golf club head according to claim 7, wherein the back groove includes a straight portion and a curved portion extending from a toe-side end of the straight portion, and the curved portion is provided in the toe out-of-line region.

12. The golf club head according to claim 1, wherein the back groove has a depth less than or equal to half a thickness of the face part.

13. The golf club head according to claim 1, wherein the back groove has a depth of greater than or equal to 0.4 mm and less than or equal to 2.4 mm.

14. The golf club head according to claim 1, wherein the score lines include a longest score line, on a middle position of the longest score line in the toe-heel direction, a center point of the hitting surface in the up-down direction is defined as the face center, the toe upper region is a region located on the upper side relative to the face center, and on a toe side relative to the face center, the toe lower region is a region located on the lower side relative to the face center, and on the toe side relative to the face center, the heel upper region is a region located on the upper side relative to the face center, and on a heel side relative to the face center, and the heel lower region is a region located on the lower side relative to the face center, and on the heel side relative to the face center.

* * * * *